US009037339B2

(12) United States Patent
Kanner et al.

(10) Patent No.: US 9,037,339 B2
(45) Date of Patent: May 19, 2015

(54) AUTOMATIC AND VITAL DETERMINATION OF TRAIN LENGTH AND CONFIGURATION

(75) Inventors: Abe Kanner, Mississauga (CA); Ioan Farcasiu, Richmond Hill (CA); Dave Dimmer, Toronto (CA)

(73) Assignee: Thales Canada Inc., Toronto, Ontario (CA)

( * ) Notice: Subject to any disclaimer, the term of this patent is extended or adjusted under 35 U.S.C. 154(b) by 238 days.

(21) Appl. No.: 13/482,735

(22) Filed: May 29, 2012

(65) Prior Publication Data

US 2013/0325247 A1 Dec. 5, 2013

(51) Int. Cl.
*B61L 15/00* (2006.01)
*B61L 25/02* (2006.01)

(52) U.S. Cl.
CPC ..... *B61L 15/0027* (2013.01); *B61L 15/0036* (2013.01); *B61L 25/028* (2013.01)

(58) Field of Classification Search
CPC ..... B61C 17/00; B61C 17/04; B61L 1/00; B61L 1/16; B61L 1/161; B61L 1/162; B61L 1/163; B61L 1/164; B61L 1/165; B61L 1/166; B61L 1/167; B61L 1/168; B61L 1/169; B61L 3/002; B61L 3/006; B61L 7/086; B61L 15/00; B61L 15/0018; B61L 15/0054; B61L 15/0063; B61L 15/0072; B61L 15/0081; B61L 25/00; B61L 25/02; B61L 25/026; B61L 25/028; B61L 25/04; H04L 2012/40293
USPC ..... 701/29.3
See application file for complete search history.

(56) References Cited

U.S. PATENT DOCUMENTS

| | | | | |
|---|---|---|---|---|
| 5,777,547 | A * | 7/1998 | Waldrop | 340/438 |
| 5,986,579 | A * | 11/1999 | Halvorson | 340/933 |
| 6,867,708 | B2 * | 3/2005 | Darby et al. | 340/933 |
| 8,254,289 | B2 * | 8/2012 | Tatsumi et al. | 370/254 |

* cited by examiner

*Primary Examiner* — Jerrah Edwards
(74) *Attorney, Agent, or Firm* — Lowe Hauptman & Ham, LLP

(57) ABSTRACT

A train system that includes a plurality of coupled train units. Each train unit includes a controller VOBC configured to independently determine the location of each VOBC, and a configuration of the train system by comprising a plurality of inputs, a plurality of train lines spanning each train unit and coupled with the controllers at the plurality of inputs and configured to transmit two communication signals between a front end and a rear end of the train system, and a plurality of sets of relay devices connected in series along the plurality of train lines, and each set of relay devices corresponding to each input of the plurality of inputs, and configured to transmit the two communication signals between the front end and the rear end of the train system.

20 Claims, 22 Drawing Sheets

TO FIG. 4B 100
50a
COUPLER
PINS
102a
VOBC
(ONE AND THE SAME)
VOBC INPUT
103
TEF
TER
104
107
108
106
A
P
1R
2R
3R
4R
5R
1F
2F
3F
4F
5F
1R'
2R'
3R'
4R'
1F'
2F'
3F'
4F'
50b
COUPLER
PINS
102b
VOBC INPUT
VOBC
(ONE AND THE SAME)

TO FIG. 5B

COUPLER
50b
PINS
PIN
108
102b
VOBC INPUT
VOBC
(ONE AND THE SAME)
104
TEF
TER
103
106
107
A
102a
VOBC
(ONE AND THE SAME)
VOBC INPUT
COUPLER
PINS
100
50a

TO FIG. 5C

50c COUPLER
PINS
PINS
110
102b
VOBC INPUT
VOBC
(ONE AND THE SAME)
104
103
TEF
TER
107
106
1R
2R
3R
4R
1F
2F
3F
4F
5F
1R'
2R'
3R'
4R'
1F'
2F'
3F'
4F'
P
102a
VOBC
(ONE AND THE SAME)
VOBC INPUT
111
200
FROM FIG. 5A

TO FIG. 6B 100
50a
COUPLER
PINS
102a
VOBC
(ONE AND THE SAME)
VOBC INPUT
103
TEF
TER
104
107
108
5R
4R
3R
2R
1R
1F
2F
3F
4F
5F
A
P
TER
TEF
106
1R
2R
3R
4R
1F
2F
3F
4F
50b
COUPLER
PINS
102b
VOBC INPUT
VOBC
(ONE AND THE SAME)

TO FIG. 6C

50c COUPLER
PINS
PINS
110
102b
VOBC INPUT
VOBC
(ONE AND THE SAME)
104
103
TEF
TER
107
106
1R
2R
3R
4R
1F
2F
3F
4F
5F
1R'
2R'
3R'
4R'
1F'
2F'
3F'
4F'
P
102a
VOBC
(ONE AND THE SAME)
VOBC INPUT
111
200
FROM FIG. 6A

TO FIG. 6D

FROM FIG. 6B
300
110
111
50d
COUPLER
PINS
102a
VOBC
(ONE AND THE SAME)
VOBC INPUT
102b
VOBC INPUT
VOBC
(ONE AND THE SAME)
103
104
106
107
TEF
TER
B
P
1R
2R
3R
4R
5R
1F
2F
3F
4F
5F

TO FIG. 7B 100
50a
COUPLER
PINS
102a
VOBC
(ONE AND THE SAME)
VOBC INPUT
103
TEF
TER
104
107
108
106
A
P
1R
2R
3R
4R
5R
1F
2F
3F
4F
5F
1R'
2R'
3R'
4R'
1F'
2F'
3F'
4F'
50b
PINS
COUPLER
102b
VOBC INPUT
VOBC
(ONE AND THE SAME)

TO FIG. 7C

50c COUPLER
PINS
PINS
110
102b
VOBC INPUT
VOBC
(ONE AND THE SAME)
104
103
TEF
TER
107
VOBC
(ONE AND THE SAME)
VOBC INPUT
111
200
FROM FIG. 7A

TO FIG. 7D

COUPLER
50d
PINS
PINS
110
111
102a
VOBC
(ONE AND THE SAME)
VOBC INPUT
102b
VOBC INPUT
VOBC
(ONE AND THE SAME)
103
104
107
TEF
TER
B
P
300
FROM FIG. 7B

TO FIG. 7E

COUPLER
50e
PINS:PIN
PINS
FROM FIG. 7C
400
110
111
102a
VOBC
(ONE AND THE SAME)
VOBC INPUT
102b
VOBC INPUT
VOBC
(ONE AND THE SAME)
103
104
106
107
TEF
TER
P
5R
4R
3R
2R
1R
1F
2F
3F
4F
5F

TO FIG. 8B

COUPLER
PINS
VOBC INPUT
VOBC
(ONE AND THE SAME)
VOBC
(ONE AND THE SAME)
VOBC INPUT
TEF
TER
600
50a
50b
102a
103
104
106
107
108

TO FIG. 8C

FROM FIG. 8A
700
110
50c
COUPLER
PINS
PINS
102b
VOBC
(ONE AND THE SAME)
VOBC INPUT
103
104
107
106
111
VOBC INPUT
VOBC
(ONE AND THE SAME)
TEF
TER
P
1R
2R
3R
4R
5R
1F
2F
3F
4F
5F

TO FIG. 8D

COUPLER
50d
PINS
110
102b
VOBC INPUT
VOBC
(ONE AND THE SAME)
104
103
106
B
107
TEF
TER
P
1R
2R
3R
4R
5R
1F
2F
3F
4F
5F
102a
VOBC
(ONE AND THE SAME)
VOBC INPUT
111
800
FROM FIG. 8B

AUTOMATIC AND VITAL DETERMINATION OF TRAIN LENGTH AND CONFIGURATION

BACKGROUND

In train systems, a train is typically made up of a plurality of train units (e.g., multiple independent cars of a base unit) coupled together. A number of train units coupled together make up the train and the train configuration/formation should be determined (e.g., the length of the train and a position of each car in the formation and the location of each of the vital on-board controllers (VOBCs) of the train). Several existing methods are used to determine the train length and position. One method is an independent verification of the train length using a secondary (i.e., external) detection system including axle counters that determine the length of the train by counting the number of axles of the train units as it enters the system. To determine a position of the VOBC, a wayside computing device determines a position of each VOBC by communicating with the VOBC on board the train unit and determining its position on the guideway thus deducing the length of the train and the position of each VOBC unit on the train. By determining the position of each VOBC, and the train length, the wayside computing device determines an order of the train units with respect to a lead end of the train In another method, a train operator manually inputs train configuration/formation information via an input device. In parallel, the secondary detection system along with the inputted configuration/formation information is used to determine train length and the VOBC position. In still another method, the inputted information may be further enhanced by performing verification through the wayside computing device via communication with each VOBC, without the use of the secondary detection system.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

One or more embodiments of the present disclosure includes a train system having a plurality of train units coupled together and in communication with each other, and a method of automatically determining train configuration/formation (i.e., train length of the train system and a position of each vital on-board controller (VOBC), using independent hardware (e.g., relays) and train lines (e.g., communication lines) to allow each VOBC of a train unit to independently and vitally determine a location of the train unit relative to a lead end or trailing end of the train system and the train length for managing train traffic, without the use of a secondary train detection system or train operator input, and irrespective of whether the train units are in a predetermined or random configuration within the train system.

Figure 1:
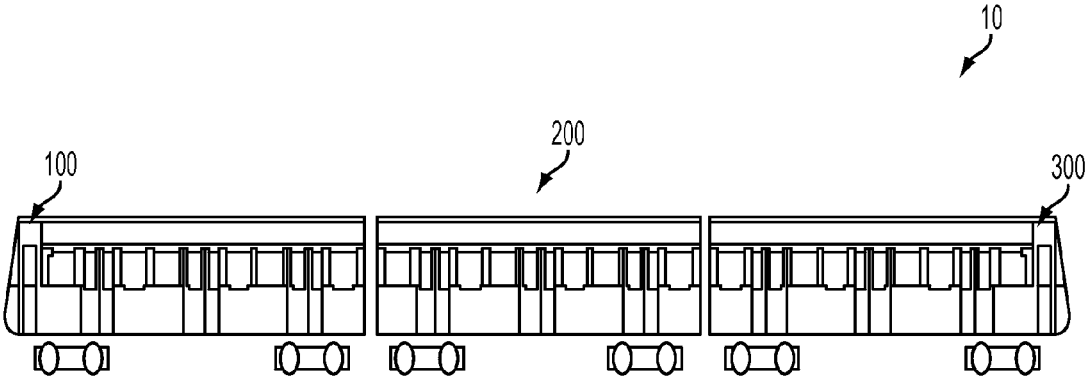
FIG. 1 is a diagram of a train system including a plurality of coupled train units in accordance with one or more embodiments.

FIG. 1 is a diagram of a train system 10 including a plurality of train units 100, 200 and 300. The train units 100, 200 and 300 are in communication with one another via train lines for example. In the train system 10, train unit 100 is the first train unit (i.e., at the lead end of the train system 10 in a travel direction) and train unit 300 is the third train unit (i.e., at the trailing end of the train system 10 in the travel direction). In one or more embodiments, each respective VOBC in train unit 100, 200 and 300 is able to determine a number of train units in front of the respective train unit 100, 200 and 300 and behind the respective train unit 100, 200 and 300 and that the train length is 3 units long.

Figure 2:
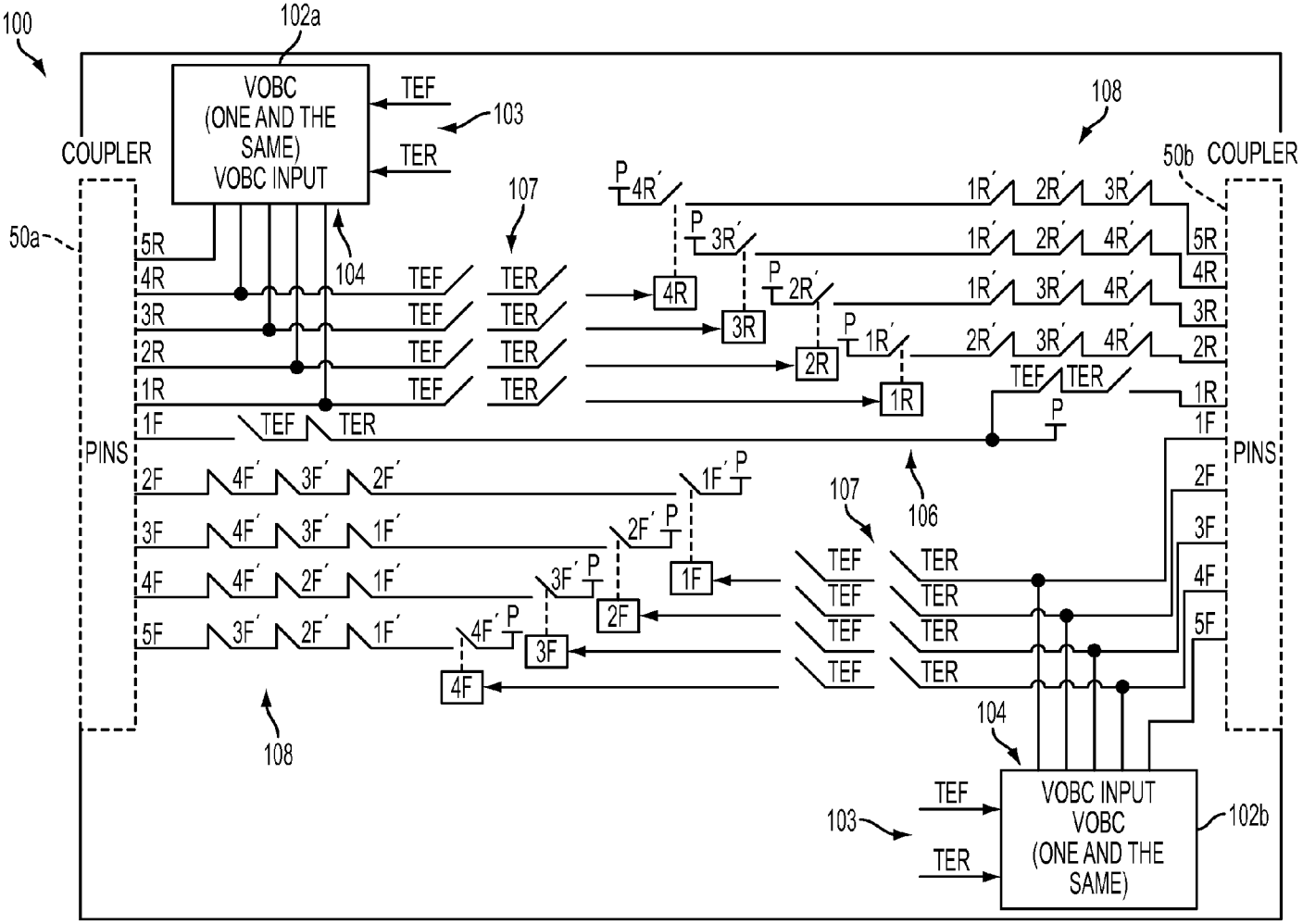
FIG. 2 is a diagram of a single train unit of the train system in accordance with one or more embodiments.
Figure 3:
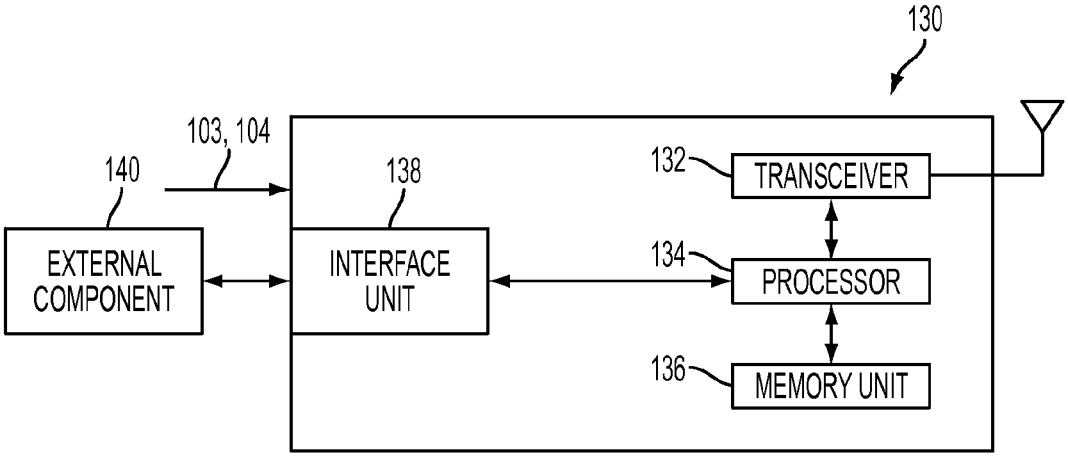
FIG. 3 is a diagram of a controller of a single train unit of the train system in accordance with one or more embodiments.

FIG. 2 is a diagram of the train unit 100 of the train system 10 in accordance with one or more embodiments. The train unit 100 includes a controller 102*a*, 102*b* (e.g., a VOBC) that determines the length and configuration of the train unit 100 via an interface unit of the controller 102*a*, 102*b* (as depicted in FIG. 3). For purposes of illustration and explanation, the controller 102 is shown as two controllers 102*a* and 102*b* (i.e., two half units) in the drawings, controller 102*a* receiving signals coming from the front of the train unit 100 and controller 102*b* receiving signals coming from the rear of the train unit 100. The controller 102*a*, 102*b* independently determines train configuration/formation, by determining a total number of train units in front of the respective train unit 100 and a total number of train units behind the respective train unit 100. Therefore, the controller 102*a*, 102*b* of the train unit 100 is able to establish both the train length of the train system 10, and train formation. In general one or more alternative embodiments, the train unit 100 includes multiple controllers 102 in a single train unit. According to other embodiments, the controller 102 is omitted from one or more train units. However, in all cases there is at least one controller in the train system 10.

As shown, the controllers 102*a* and 102*b* have a plurality of inputs 103 and 104. The inputs 104 include a train end front relay (TEF) input and a train end rear relay (TER) input, 1F, 2F, 3F, 4F and 5F as train formation inputs rear and 1R, 2R, 3R, 4R and 5R as train formation inputs front. The inputs 103 include status relays for TEF and TER relay devices 107. The inputs 104 are connected with pins at a coupler 50, to the controllers 102*a* and 102*b* for receiving communication signals transmitted along train lines 106 spanning the train unit 100 and coupled to the inputs 104. The number of the inputs 104 depends on a maximum number of train units allowed within the train system 10 (i.e., the allowed maximum train length). For example, the controllers 102*a*, 102*b* each include a total of five (5) corresponding inputs 104 (i.e., 1R through 5R and 1F through 5F).

The train unit 100 further includes a plurality of sets of relay devices 107 and 108 along the train lines 106 in series. The relay devices enable a determination of a correct configuration of the train unit 100 whether coupled or uncoupled. The plurality of sets of relay devices include TEF relay devices and TER relay devices 107 and relay devices 108 (1R', 2R', 3R', 4R' and 5R' and 1F', 2F', 3F', 4F' and 5F') including coils thereof. The relays 108 correspond to the inputs 104 (1F, 2F, 3F, 4F and 5F and 1R, 2R, 3R, 4R and 5R). The relays 108 are between TEF and TER and the other inputs 104. The relays 108 are energized by a power source P only in train units which are coupled at both ends. Relays 108 within the front and rear train units are not energized. For purpose of explanation, the energized relays 108 in the coupled train units, are referred to as relays 110 (i.e., 1R', 2R', 3R', 4R' and 5R') and 111 (i.e., 1F', 2F', 3F', 4F' and 5F'). Relay 110 is energized by the communication signal "A" and relay 111 is energized by communication signal "B". Each train unit coupled at both ends includes 2 relays 110, 111 energized at a time. The relays 110, 111 are energized by the communication signals "A" and "B" according to the location of the train unit in the train system 10.

TEF and TER signals are generated by the train unit 100 according to the coupling status of the train unit 100. That is, TEF and TER are automatically energized or de-energized by the coupler 50*b*, based upon whether the train unit 100 is uncoupled or coupled with another train unit, and thereby confirming that a particular end of the train unit 100 is uncoupled or coupled with another train unit. If the train unit 100 is uncoupled then both TEF and TER are de-energized. If the train unit 100 is coupled to other train units at both ends thereof then both TEF and TER are energized. If the train unit 100 is coupled to another train unit only at one end then either TEF or TER is energized. In one embodiment, TER and TEF and the relay devices 108 are force actuated relays which have a characteristic that allows failure of the relays 108 to be determined. The status relays 103 indicate whether TEF and TER are energized within train unit 100. As further shown in FIG. 2, the train unit 100 is uncoupled from other train units. Thus, both TEF and TER are de-energized. In addition, the inputs 104 of the controllers 102*a* and 102*b* are de-energized. None of the relays 108 are energized.

FIG. 3 is a high-level functional block diagram of a controller 300 usable as controller 102*a*, 102*b* (FIG. 1) of a train unit 100 of the train system 10 in accordance with one or more embodiments. Controller 130 comprises a transceiver 132, a processor 134, a memory unit 136, and an interface unit 138. The components of controller 130 (i.e., transceiver 132, processor 134, memory unit 136, and interface unit 138) are communicably connected to processor 134. In at least some embodiments, controller 130 components are communicably connected via a bus or other intercommunication mechanism.

Transceiver 132 receives and/or transmits signals between train units of the train system 10. In at least some embodiments, transceiver 132 comprises a mechanism for connecting to a network. In at least some embodiments, transceiver 132 is an optional component. In at least some other embodiments, controller 130 comprises more than a single transceiver 132. In at least some embodiments, transceiver 132 comprises a wired and/or wireless connection mechanism. In at least some embodiments, controller 130 connects via transceiver 132 to one or more additional controllers.

Processor 134 is a processor, programmed/programmable logic device, application specific integrated circuit or other similar device configured to execute a set of instructions to perform one or more functions according to an embodiment. In at least some embodiments, processor 134 is a device configured to interpret a set of instructions to perform one or more functions. Processor 134 processes signals (i.e., signals input via inputs 103 and 104) received by the train unit 100.

Memory unit 136 (also referred to as a computer-readable medium) comprises a random access memory (RAM) or other dynamic storage device, coupled to processor 134 for storing data and/or instructions to be executed by processor 134 for determining train configuration and/or location, location information, and configuration information of the train unit 100 as determined. Memory unit 136 also may be used for storing temporary variables or other intermediate information during execution of instructions to be executed by processor 134. In at least some embodiments, memory unit 306 comprises a read only memory (ROM) or other static storage device coupled to the processor 134 for storing static information or instructions for the processor.

In at least some embodiments, a storage device, such as a magnetic disk, optical disk, or electromagnetic disk, is provided and coupled to the processor 134 for storing data and/or instructions.

In at least some embodiments, one or more of the executable instructions for determining train configuration and/or location, location information, and/or configuration information are stored in one or more memories of other controllers communicatively connected with controller 130. In at least some embodiments, a portion of one or more of the executable instructions for determining train configuration and/or location, location information, and/or configuration information are stored among one or more memories of other computer systems.

Interface unit 138 is an interface between the processor 134 and an external component 140 such as a transponder reader which receives location information from passive transponders installed on train tracks, for example. The interface unit 138 receives the processed signals from the processor 134 and the information from the external component 140, and determines a location, safe stopping distance, and/or compliance with speed restrictions of the train unit 100, for example. In at least some embodiments, interface unit 138 is an optional component.

The present disclosure is not limited to the controller 130 including the components as shown in FIG. 3 and includes other components suitable for performing functions of the controller 130 as set forth herein.

Additional details regarding communication between train unit 100 and other train units of the train system 10 will be discussed below with reference to FIGS. 4A through 8D and Tables 40 through 80.

Figure 4A:
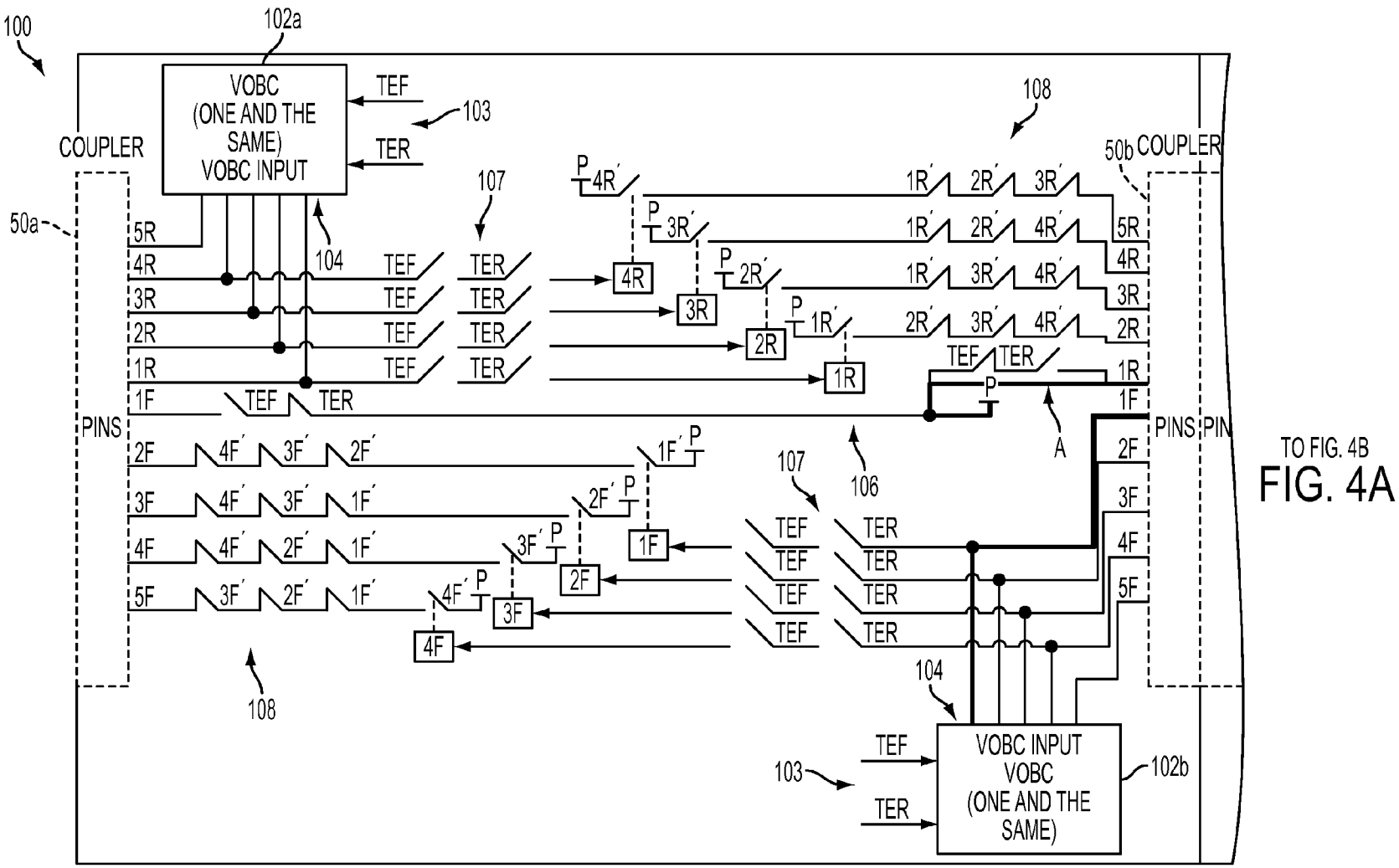
FIGS. 4A and 4B are diagrams of a pair of train units coupled together in a predetermined configuration in accordance with one or more embodiments.
Figure 4B:
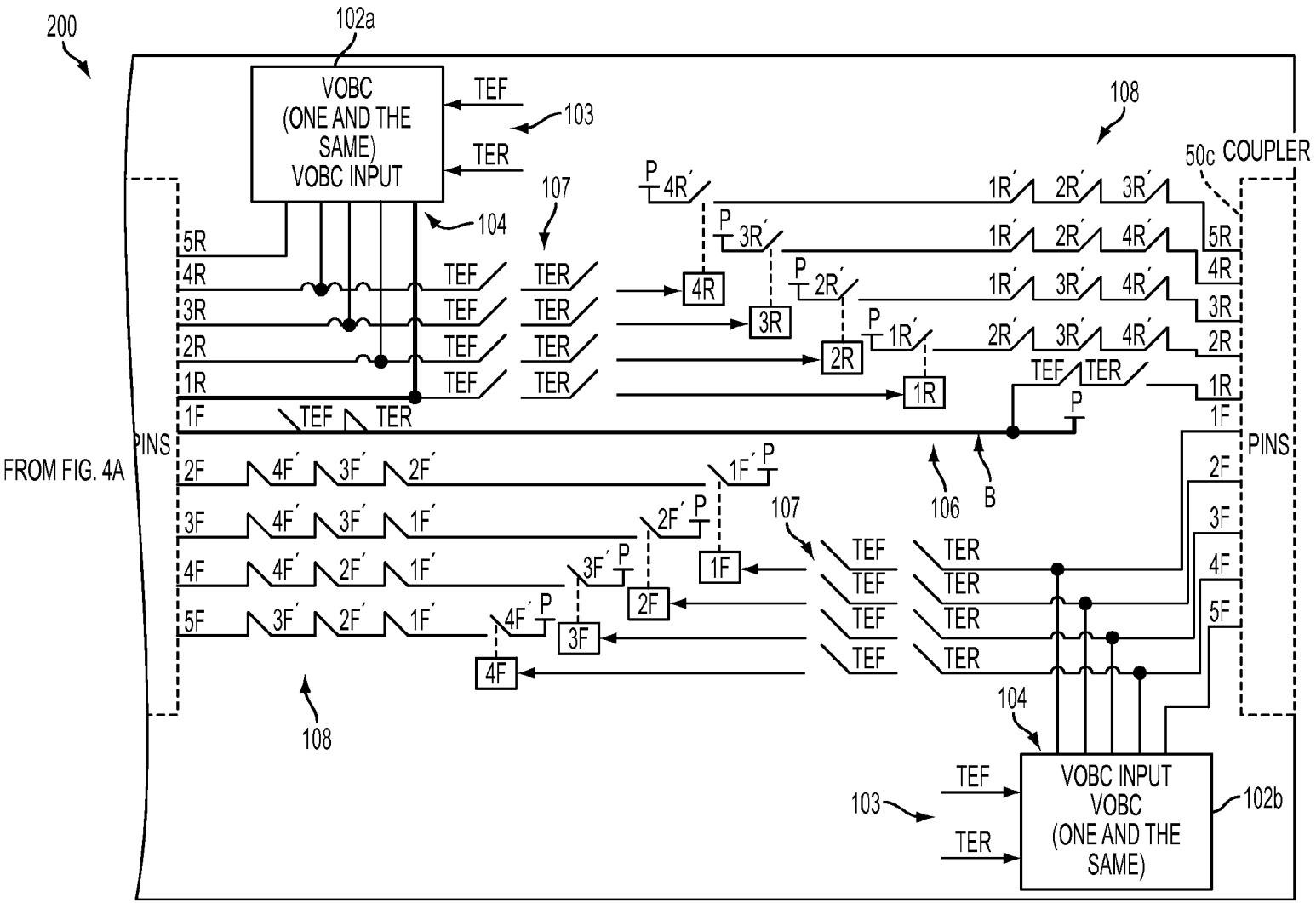

FIGS. 4A and 4B are diagrams of a pair of train units 100 and 200 coupled together in a predetermined configuration in accordance with one or more embodiments. Communication signals (e.g., first and second communication signals) are transmitted via the train lines 106 between the train units 100 and 200. The first communication signal "A" is transmitted from a front end of the train system 10 as shown in FIG. 4A, and the second communication signal "B" is transmitted from a rear end of the train system 10 as shown in FIG. 4B, cascading along the train lines 106 between the train units 100 and 200. The first and second communication signals "A" and "B" are each generated at an uncoupled end of the train system 10 (i.e., at the front unit and the rear train unit) and are then cascaded through the train system 10 from front to back and back to front. The status of each input of the controllers 102*a*, 102*b* of train units 100 and 200 is shown in Table 40 (VOBC inputs shown in FIGS. 4A and 4B) as follows:

| VOBC Inputs | 100 | 200 |
|---|---|---|
| TEF | NE | EN |
| TER | EN | NE |
| 1F | EN | NE |
| 2F | NE | NE |
| 3F | NE | NE |
| 4F | NE | NE |
| 5F | NE | NE |
| 1R | NE | EN |
| 2R | NE | NE |
| 3R | NE | NE |
| 4R | NE | NE |
| 5R | NE | NE |

where "NE" stands for not energized and "EN" stands for energized.

In the train unit 100 shown in FIG. 4A, TER is automatically energized via the coupler 50*b* between the train unit 100 and the train unit 200 (shown in FIG. 4B) to indicate that the train unit 100 is coupled at a rear thereof to train unit 200. The first communication signal "A" is then transmitted along train line 106 at input 1R of the train unit 100, to the train unit 200 thereby energizing the input 1R at the controller 102*a* of the train unit 200 indicating to the controller 102*a*, that there is one train unit (e.g., train unit 100) in front of the train unit 200. At the same time, in the train unit 200 shown in FIG. 4B, TEF is energized via the coupler 50*b* between train units 100 and 200 to indicate that the train unit 200 is coupled at a front thereof to train unit 100, and the second communication signal "B" is transmitted along train line 106 to the train unit 100 via input 1F, energizing the input 1F at the controller 102*b* of the train unit 100 shown in FIG. 4A indicating to the controller 102*b* that there is one train unit (e.g., the train unit 200) behind the train unit 100. Each controller 102 receives a single input from the communication signal A and B (i.e., the controller 102*a* receives one signal corresponding to communication signal "A" and the controller 102*b* receives one signal corresponding to communication signal "B"). None of the relay devices 108 in train units 100 and 200 are energized.

Figure 5A:
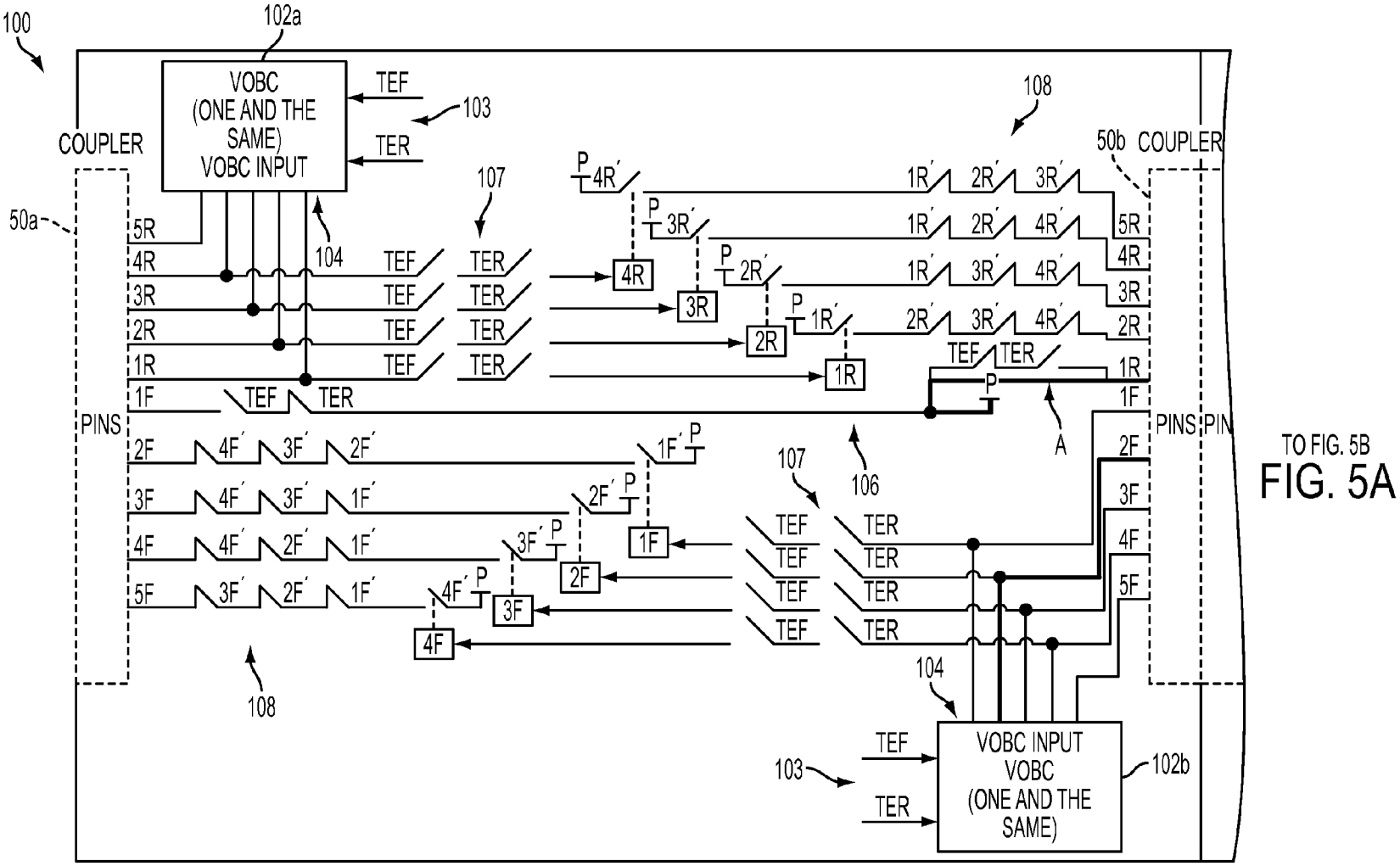
FIGS. 5A through 5C are diagrams of three train units coupled together in a predetermined configuration in accordance with one or more embodiments.
Figure 5B:
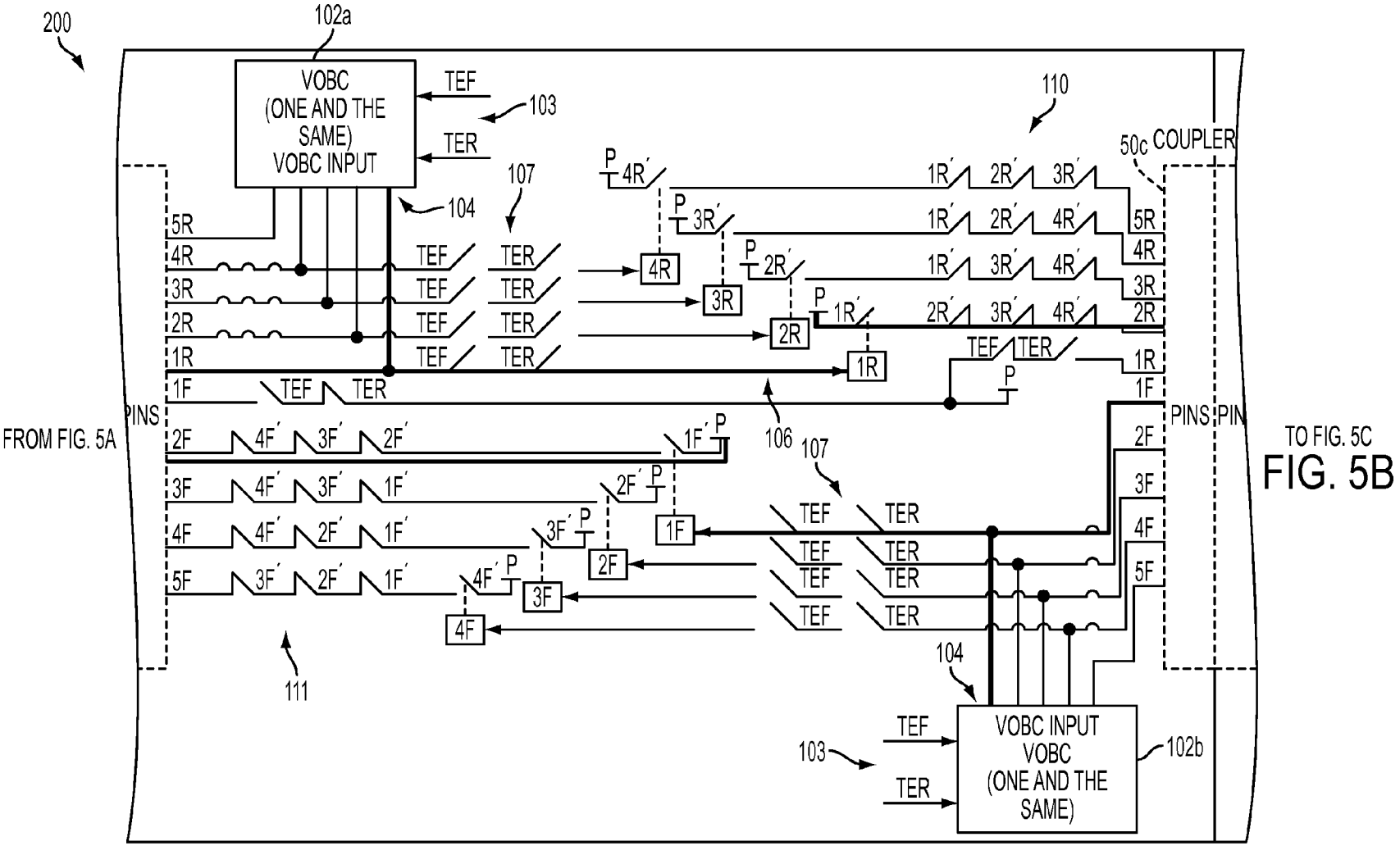
Figure 5C:
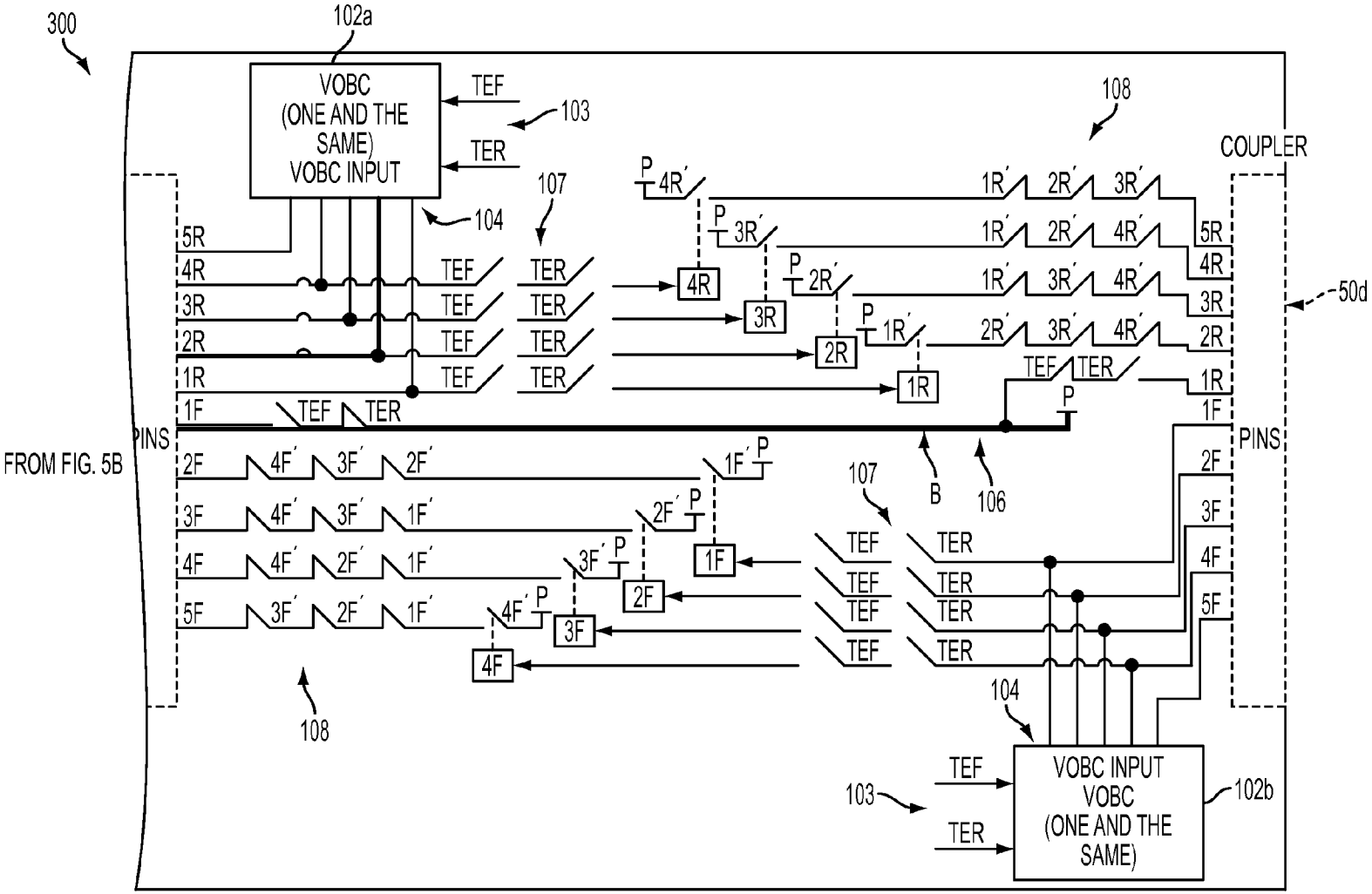

FIGS. 5A through 5C are diagrams of three train units 100, 200, and 300 coupled together in a predetermined configuration in accordance with one or more embodiments. The status of each input of the controllers 102 of train units 100, 200 and 300 is shown in Table 50 (VOBC inputs shown in FIGS. 5A through 5C) as follows:

| VOBC Inputs | 100 | 200 | 300 |
|---|---|---|---|
| TEF | NE | EN | EN |
| TER | EN | EN | NE |
| 1F | NE | EN | NE |
| 2F | EN | NE | NE |
| 3F | NE | NE | NE |
| 4F | NE | NE | NE |
| 5F | NE | NE | NE |
| 1R | NE | EN | NE |
| 2R | NE | NE | EN |
| 3R | NE | NE | NE |
| 4R | NE | NE | NE |
| 5R | NE | NE | NE |

As shown in FIG. 5A, in the train unit 100, TER is energized via the coupler 50*b* between the train units 100 and 200 to indicate that the train unit 100 is coupled at the rear thereof to train unit 200, thereby transmitting a first communication signal "A" via input 1R, and energizes input 1R at the controller 102*a* of the train unit 200 indicating that one train unit (e.g., the train unit 100) is in front of the train unit 200. None of the relays 108 of the train unit 100 are energized.

As shown in FIG. 5B, the train unit 200, both TEF and TER are energized by respective couplers 50*b*, 50*c* at both sides of the train unit 200 to indicate that train unit 200 is coupled to another train (i.e., the train unit 100 and the train unit 300) at both sides of the train unit 200. Further, the first communication signal "A" then travels along a train line 106 where the relay 110 (1R') is energized via the input 1R and then energizes the input 2R of the train unit 300 at the controller 102*a* of the train unit 300 indicating to the controller 102*a*, that there are two train units (e.g., train units 100 and 200) in front of the train unit 300. No relays 108 are energized within the train unit 300, thereby indicating to the controllers 102*a* and 102*b* that there are no train units behind the train unit 300. As shown, the first communication signal "A" cascades along the train lines 106 between the train units 100, 200 and 300.

As shown in FIG. 5C, at the same time, the second communication signal "B" is transmitted from train unit 300 at the rear of the train system 10 to train unit 100 at the front of the train system 10. In the train unit 300, TEF is energized via the coupler 50*c* between the train units 200 and 300 to indicate that the train unit 300 is coupled at a front thereof to train unit 200, the second communication signal "B" is then transmitted via the input 1F of the train unit 300 shown in FIG. 5B. The second communication signal "B" then energizes an input 1F at the controller 102*b* of the train unit 200 indicating to the controller 102*b* that there is one train unit (e.g., train unit 300) behind train unit 200. In train unit 200, the second communication signal "B" then travels along train line 106 and passes through the energized TEF at input 1F, and energizes the relay 111 (1F') coupled with input 2F thereof. The second communication signal "A" is then transmitted to the train unit 100 (as shown in FIG. 5A) and energizes the input 2F thereof at the controller 102*b* of the train unit 100 indicating that there are two train units (e.g., train units 200 and 300) behind the train unit 100. None of the relays 108 within the train unit 100 are energized, thereby indicating that there are no train units in front of the train unit 100.

The controllers 102*a* and 102*b* of each train unit 100, 200 and 300 are configured to independently determine a number of units included within the train system 10 (i.e., the train length) and a location of the respective controller 102*a* and 102*b* in the train unit 100, 200 and 300 relative to a front of the train system 10. The controllers 102*a* and 102*b* operate independent of other controllers 102*a* and 102*b* of the train system 10 such that the operability thereof is not dependent upon the operability of other controllers 102*a* and 102*b* on other train units of the train system 10. That is, each controller 102*a* and 102*b* is capable of determining an overall configuration/formation of the train system without the need for other controllers 102*a* and 102*b* to be operational. For example, if the controller 102*a* of train unit 200 is inoperable (or omitted), upon energizing TER within the train unit 100, the first communication signal "A" energizes the input 1R and the relay 110 (1R') in the train unit 200, and continues traveling along train line 106 to the train unit 300 and energizes input 2R thereof, and is then transmitted to the controller 102*a* of train unit 300 via the energized input 2R, indicating to the controller 102*a* that there are two train units in front of the train unit 300, without relaying the first communication signal "A" to the controller 102*a* of the train unit 200.

Further, as shown in FIG. 5A, the first communication signal "A" is transmitted from the front end of each train units 100, 200 and 300, and the second communication signal "B" is transmitted from a rear end of each train unit 100, 200 and 300, cascading along the train lines 106 between the train units 100, 200, 300. The first and second communication signals "A" and "B" each energize a relay 110, 111 and an input 104 in a train unit (e.g., train unit 200) which is coupled at both ends. For train units (e.g., lead train unit 100 and trailing train unit 300) which are only coupled at one end, only an input 104 is energized and none of the relays 108 therein are energized.

FIGS. 6A through 6D are diagrams of four train units 100, 200, 300 and 400 coupled together in a predetermined configuration in accordance with one or more embodiments. The status of each input of the controllers 102 of train units 100, 200, 300 and 400 is shown in Table 60 (VOBC inputs shown in FIGS. 6A through 6D) as follows:

| VOBC Inputs | 100 | 200 | 300 | 400 |
|---|---|---|---|---|
| TEF | NE | EN | EN | EN |
| TER | EN | EN | EN | NE |
| 1F | NE | NE | EN | NE |
| 2F | NE | EN | NE | NE |
| 3F | EN | NE | NE | NE |
| 4F | NE | NE | NE | NE |
| 5F | NE | NE | NE | NE |
| 1R | NE | EN | NE | NE |
| 2R | NE | NE | EN | NE |
| 3R | NE | NE | NE | EN |
| 4R | NE | NE | NE | NE |
| 5R | NE | NE | NE | NE |

Figure 6A:
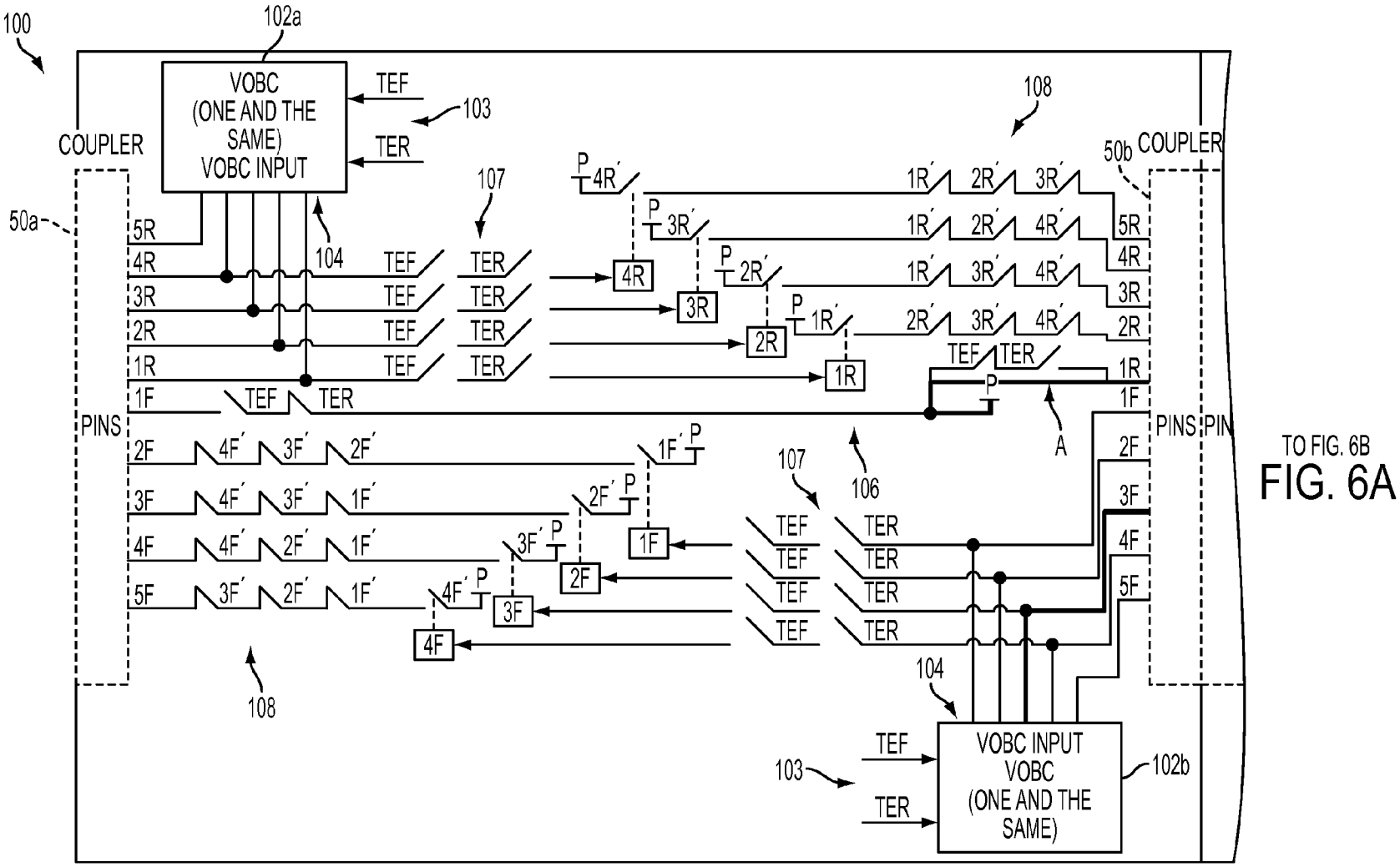
FIGS. 6A through 6D are diagrams of four train units coupled together in a predetermined configuration in accordance with one or more embodiments.
Figure 6B:
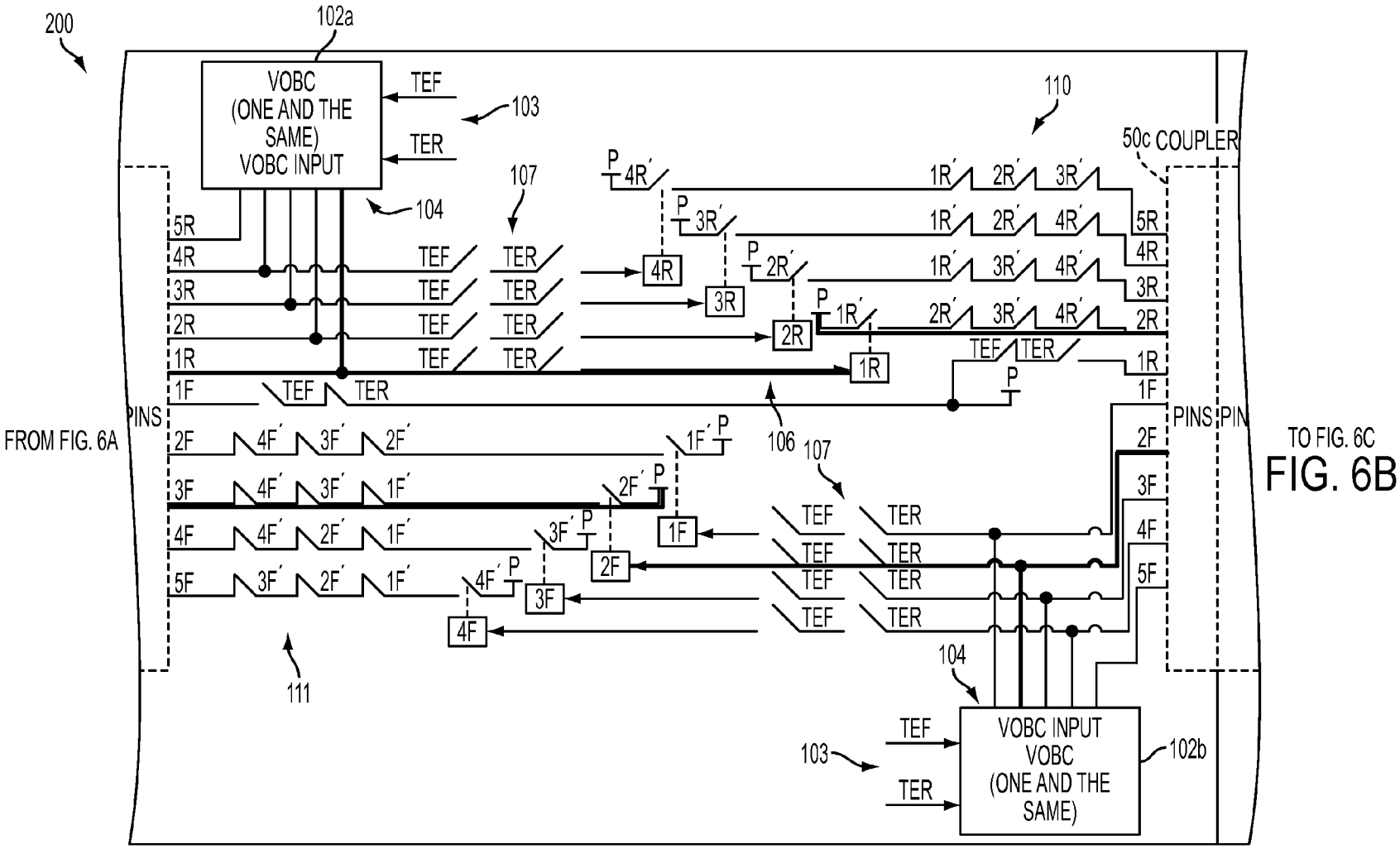
Figure 6C:
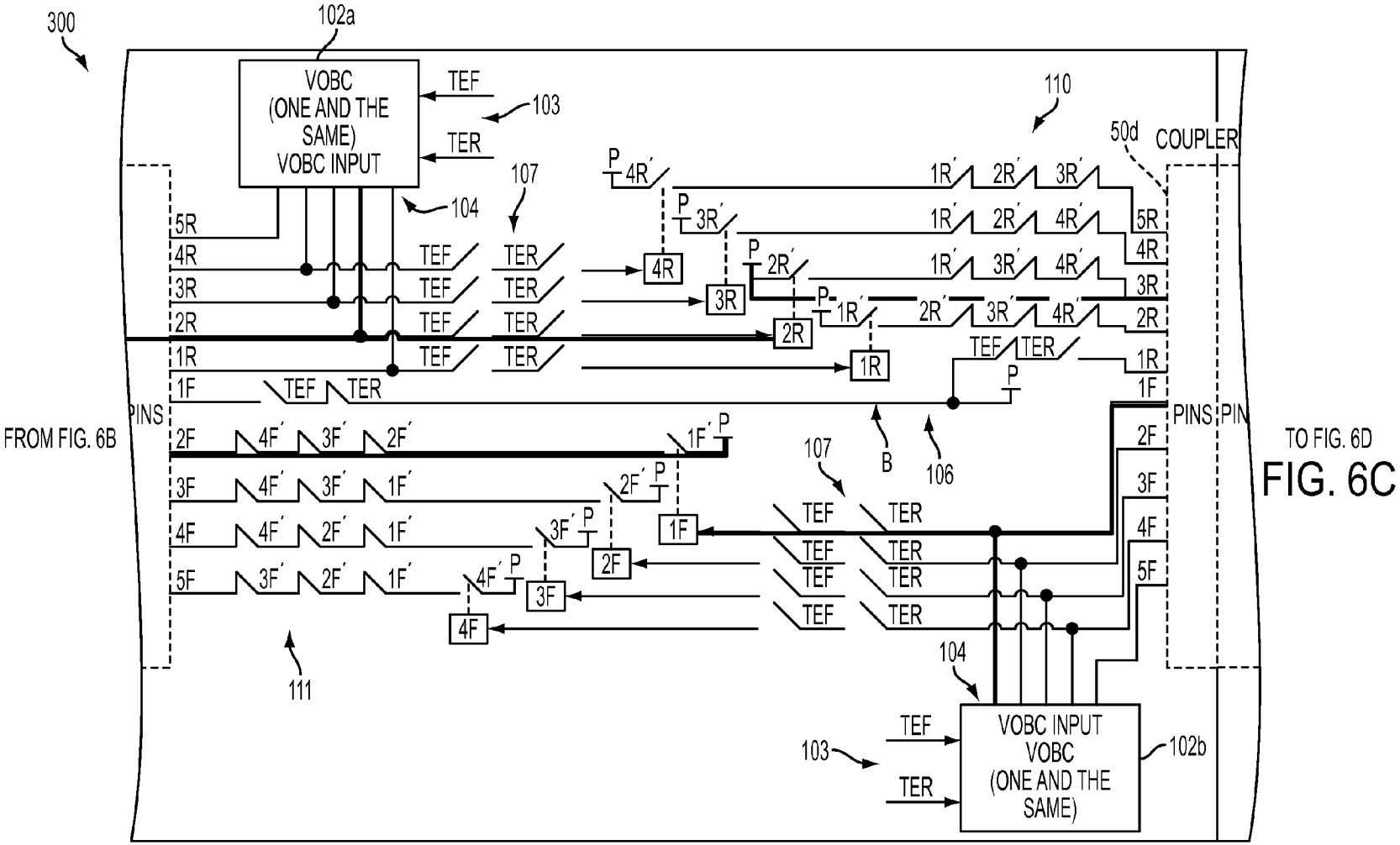
Figure 6D:
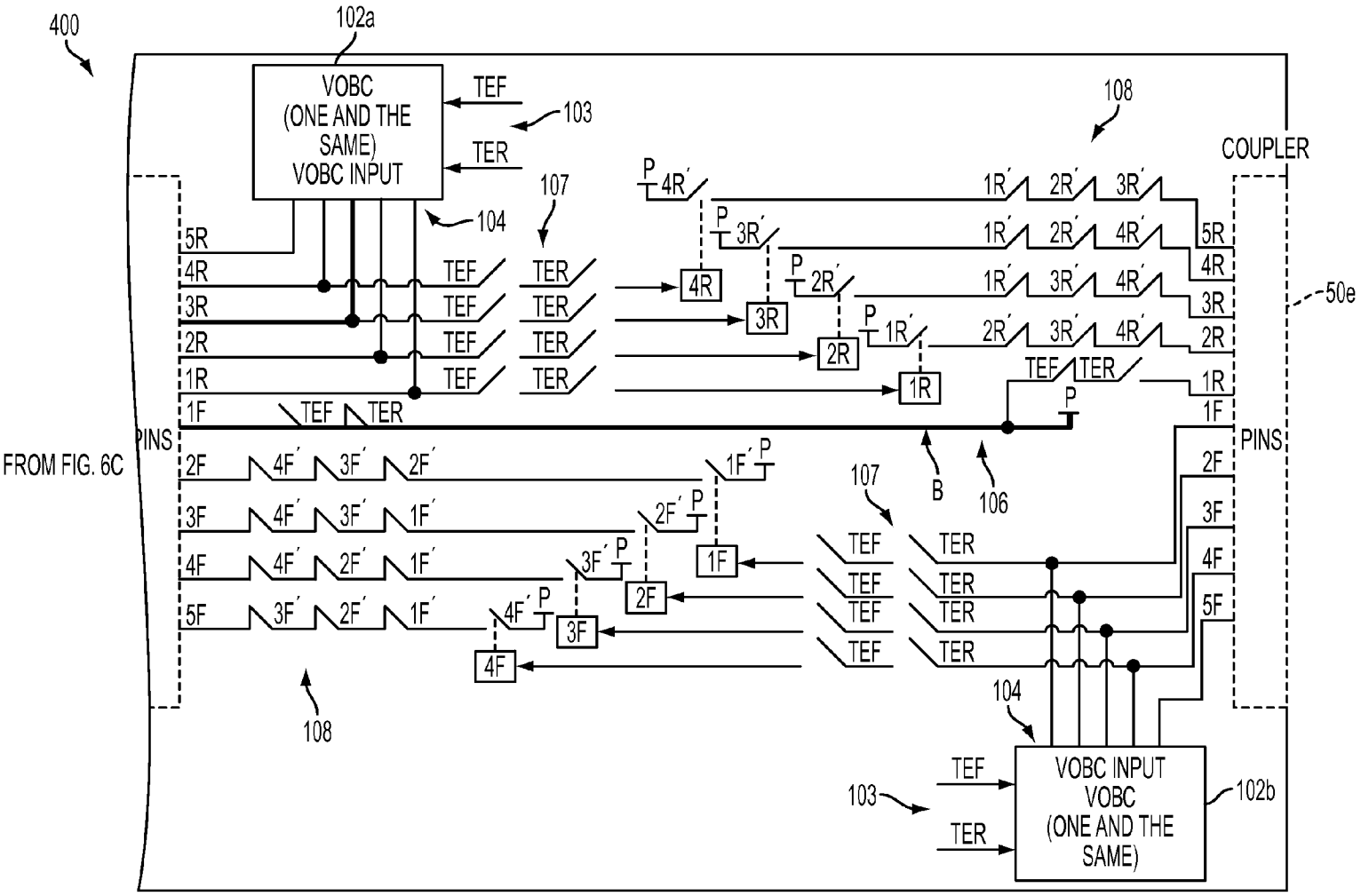

In FIG. 6A, the first communication signal "A" is transmitted between train units 100, 200 and 300 as discussed above in FIGS. 5A through 5C therefore a further discussion thereof is omitted. In the train unit 300 shown in FIG. 6C, since train unit 400 (shown in FIG. 6D) is behind the train unit 300, TER is energized. The first communication signal "A energizes the relay 110 (2R') travels to train unit 400 and energizes input 3R at the controller 102*a* of the train unit 400 indicating to the train unit 400 that there are three train units (e.g., the train units 100, 200 and 300) in front of the train unit 400.

At the same time, in train unit 400 (at the rear of the train system 10), the second communication signal "B" is transmitted toward the front of the train system 10. TEF is energized via the coupler 50*d*. The second communication signal "B" is transmitted via the input 1F to the train unit 300 shown in FIG. 6C, energizing input 1F at the controller 102*b* thereby indicating that one train unit (e.g., train unit 400) is behind train unit 300. As TEF is energized (coupled both ends) within the train unit 300 and the second communication signal "B" continues to travel along train line 106 and energizes the relay 111 (1F') therein which in turn energizes input 2F at the controller 102*b* of the train unit 200 shown in FIG. 6B indicating that there are two train units (e.g., train units 300 and 400) behind train unit 200. As TEF of the train unit 200 is energized (coupled both ends) and the second communication signal "B" is then transmitted within the train unit 200 and the relay 111 (2F') is energized, thereby energizing input 3F at the controller 102*b* of the train unit 100 shown in FIG. 6A indicating that there are three train units (e.g., train units 200, 300 and 400) behind the train unit 100.

Thus, according to one or more embodiments, the communication signals "A" and "B" depending on the train configuration together with the relays 108 set up automatically, different inputs into each controller 102*a*, 102*b* so that each controller 102*a*, 102*b* determines the train configuration (i.e., train length and location of the respective controller 102*a*, 102*b* in the train system 10) uniquely by varying the configuration of the inputs 104 to each controller 102*a*, 102*b*. The selected inputs 104 to the controllers 102*a* and 102*b* are energized depending upon the number of train units in front and behind a respective train unit 100, 200, 300 or 400.

FIGS. 7A through 7E are diagrams of five train units 100, 200, 300, 400 and 500 coupled together in a predetermined configuration in accordance with one or more embodiments. The status of each input of the controllers 102*a*, 102*b* of train units 100, 200, 300, 400 and 500 is shown in Table 70 (VOBC inputs shown in FIGS. 7A through 7E) as follows:

| VOBC Inputs | 100 | 200 | 300 | 400 | 500 |
|---|---|---|---|---|---|
| TEF | NE | EN | EN | EN | EN |
| TER | EN | EN | EN | EN | NE |
| 1F | NE | NE | NE | EN | NE |
| 2F | NE | NE | EN | NE | NE |
| 3F | NE | EN | NE | NE | NE |
| 4F | EN | NE | NE | NE | NE |
| 5F | NE | NE | NE | NE | NE |
| 1R | NE | EN | NE | NE | NE |
| 2R | NE | NE | EN | NE | NE |
| 3R | NE | NE | NE | EN | NE |
| 4R | NE | NE | NE | NE | EN |
| 5R | NE | NE | NE | NE | NE |

In FIGS. 7A through 7E, the first communication signal "A" is transmitted between train units 100, 200, 300 and 400 as discussed above in FIG. 6; therefore, a discussion thereof is omitted. Further, in train unit 400 shown in FIG. 7D, since the train unit 500 (shown in FIG. 7E) is behind train unit 400, TER is energized via the coupler 50*e*. The first communication signal "A" energizes the relay 110 (3R') and in turn energizes the input 4R at controller 102*a* of the train unit 500 indicating to the train unit 500 that there are four train units (e.g., the train units 100, 200, 300 and 400) in front of the train unit 500.

Figure 7A:
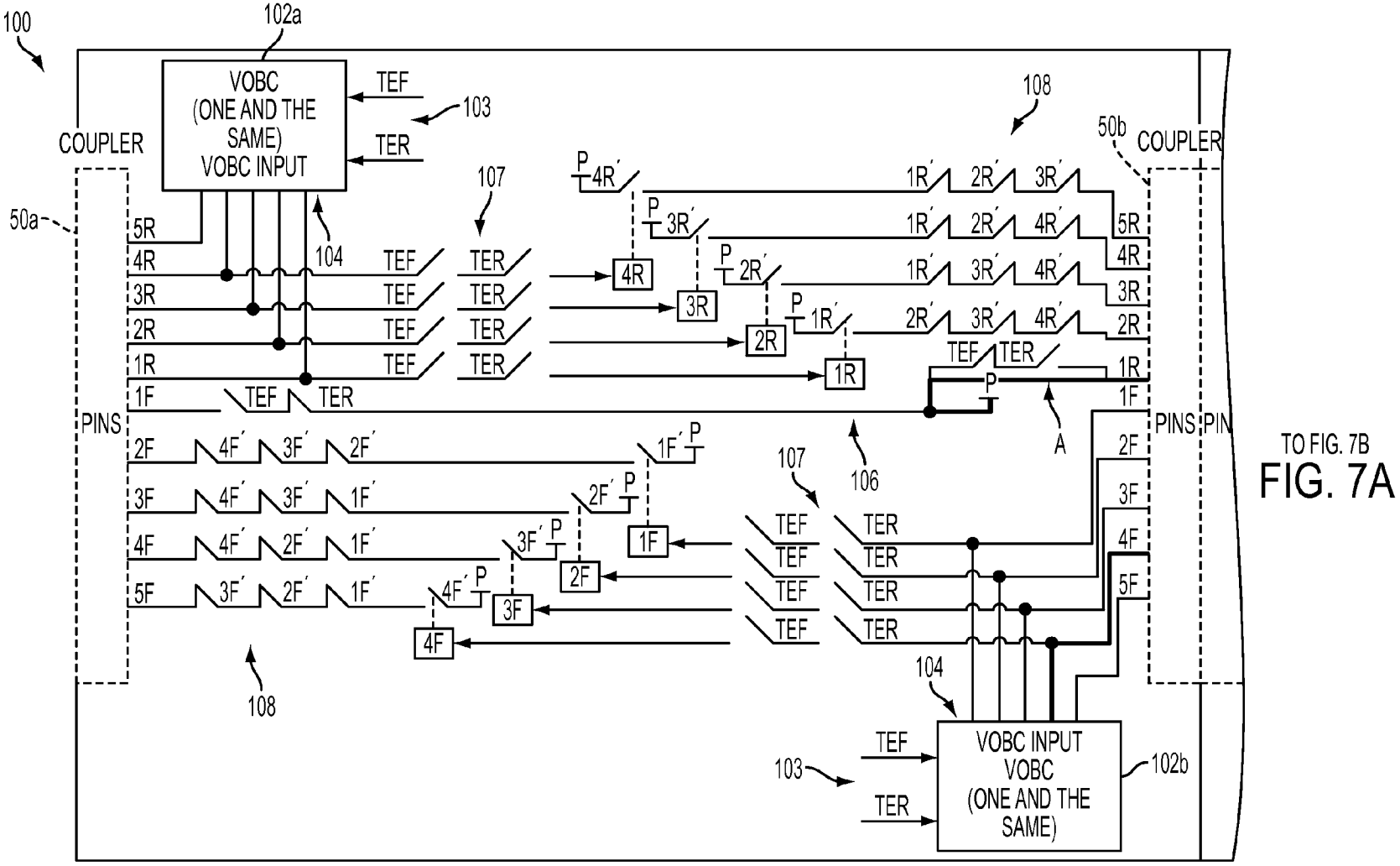
FIGS. 7A through 7E are diagrams of five train units coupled together in a predetermined configuration in accordance with one or more embodiments.
Figure 7B:
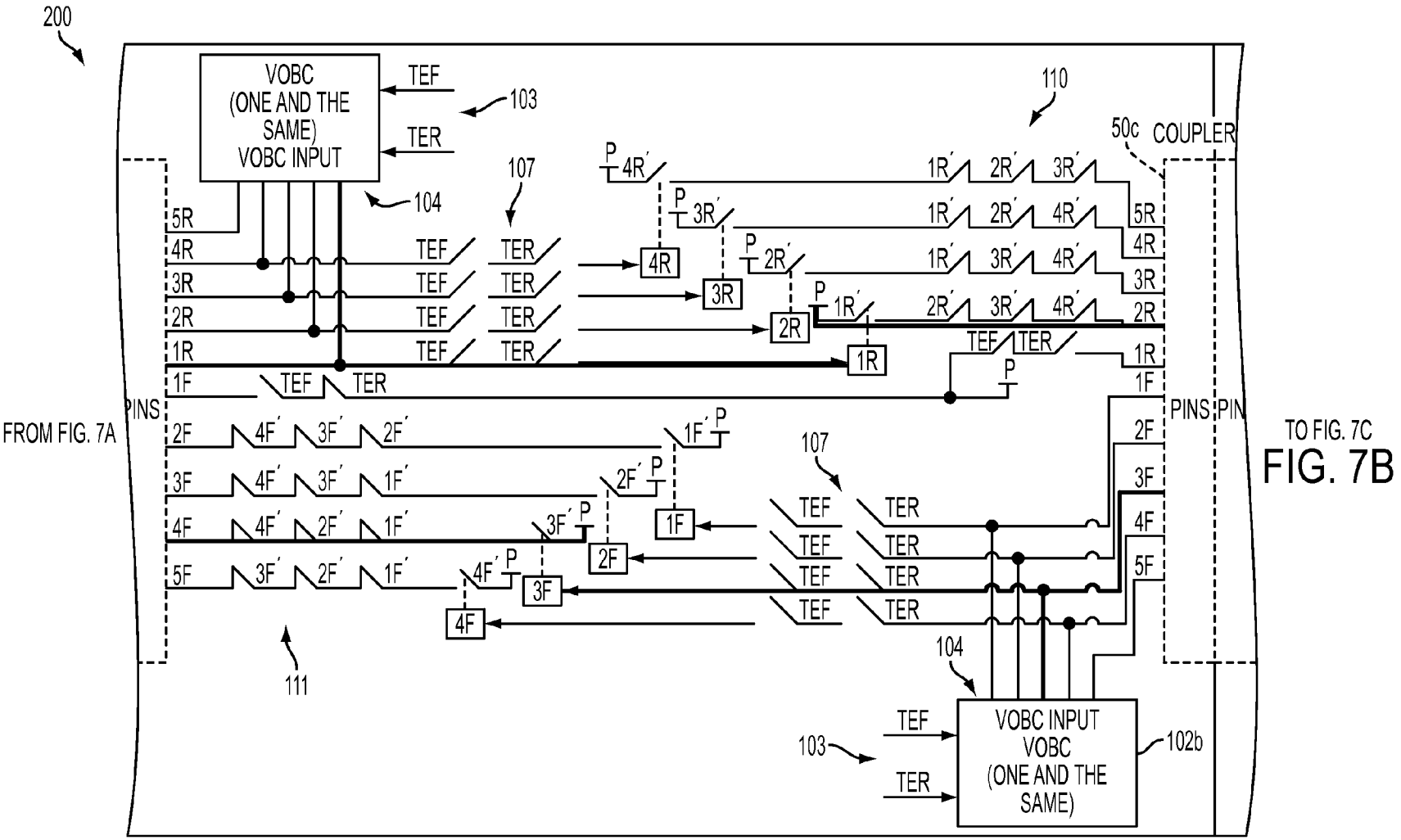
Figure 7C:
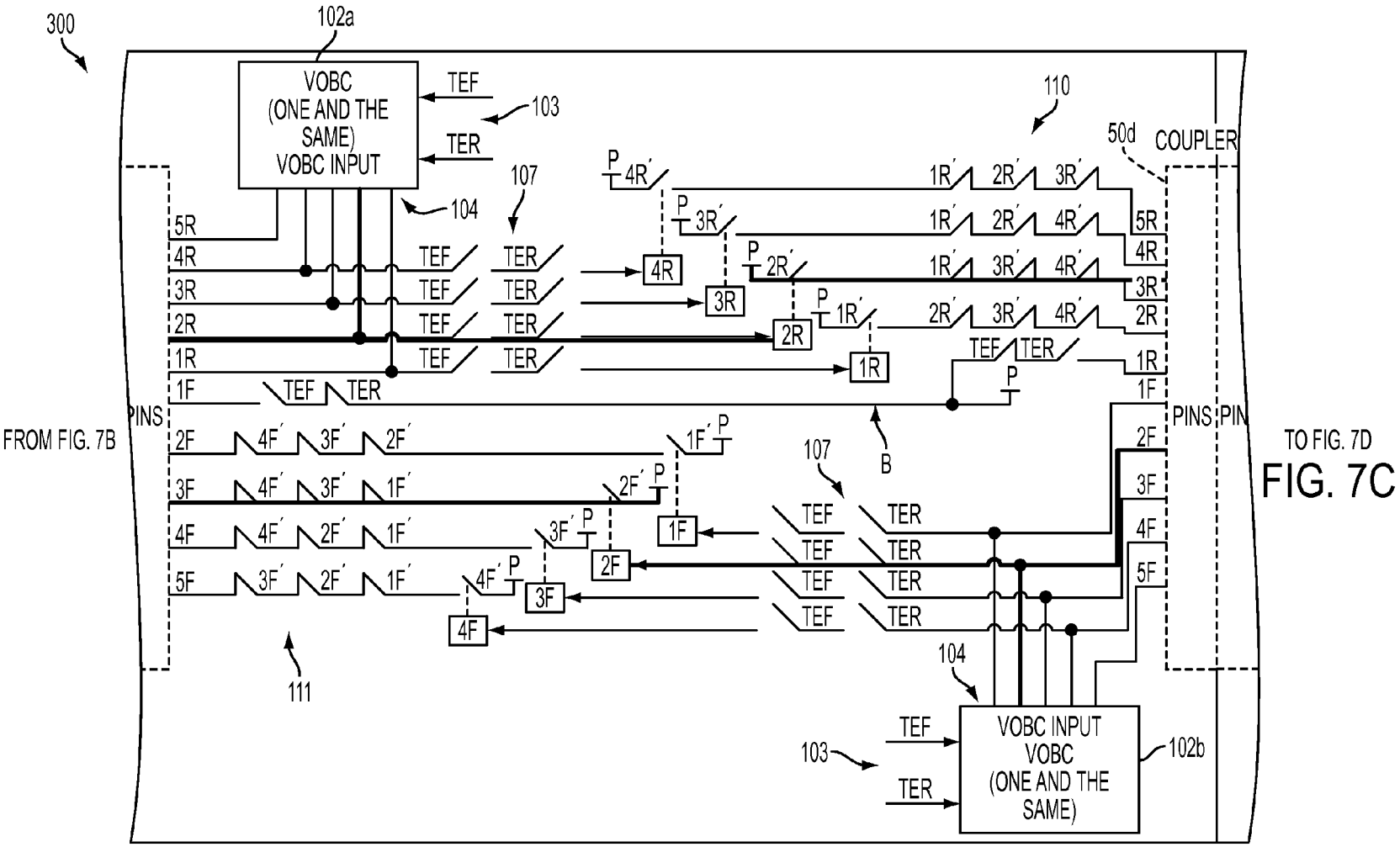
Figure 7D:
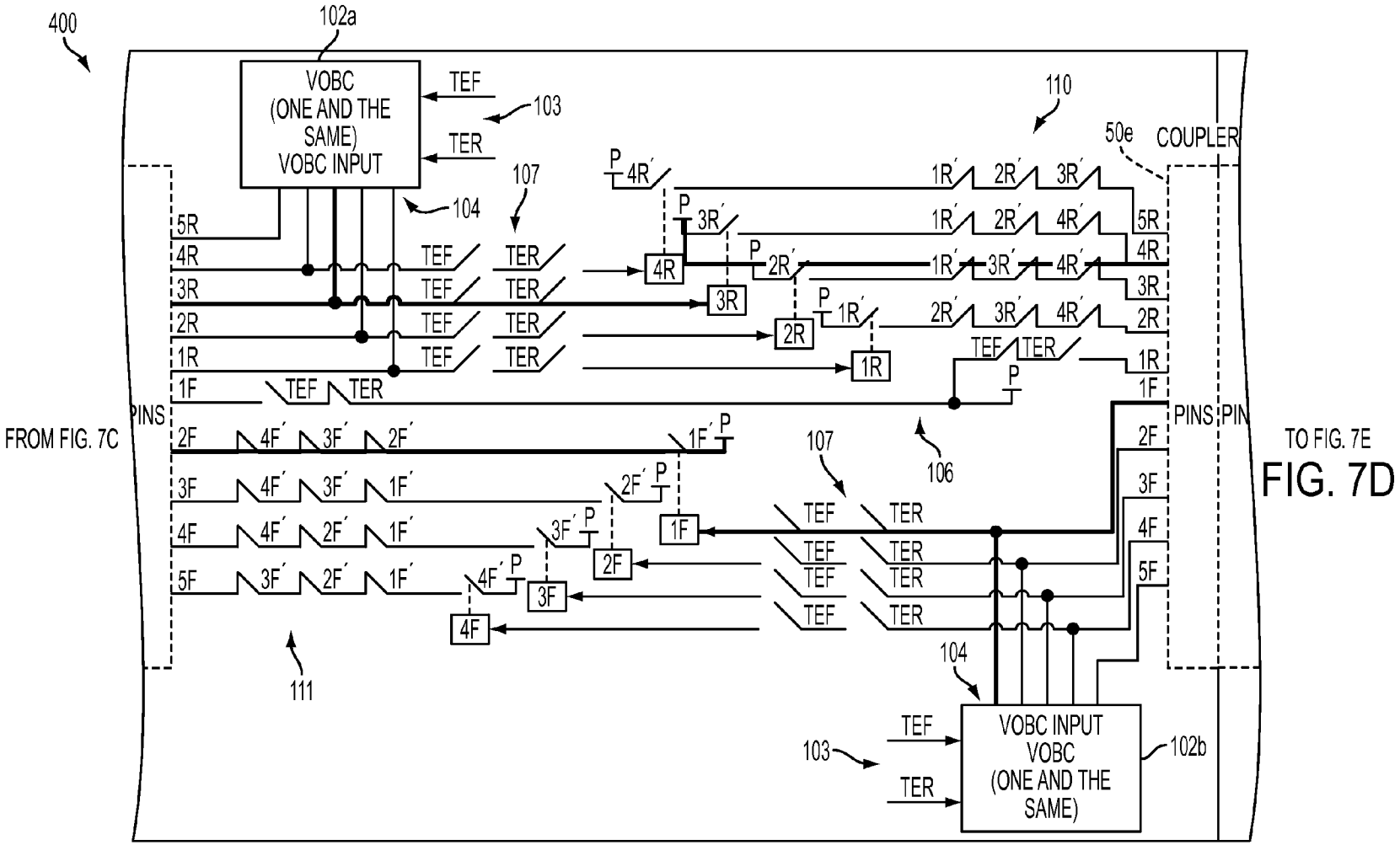
Figure 7E:
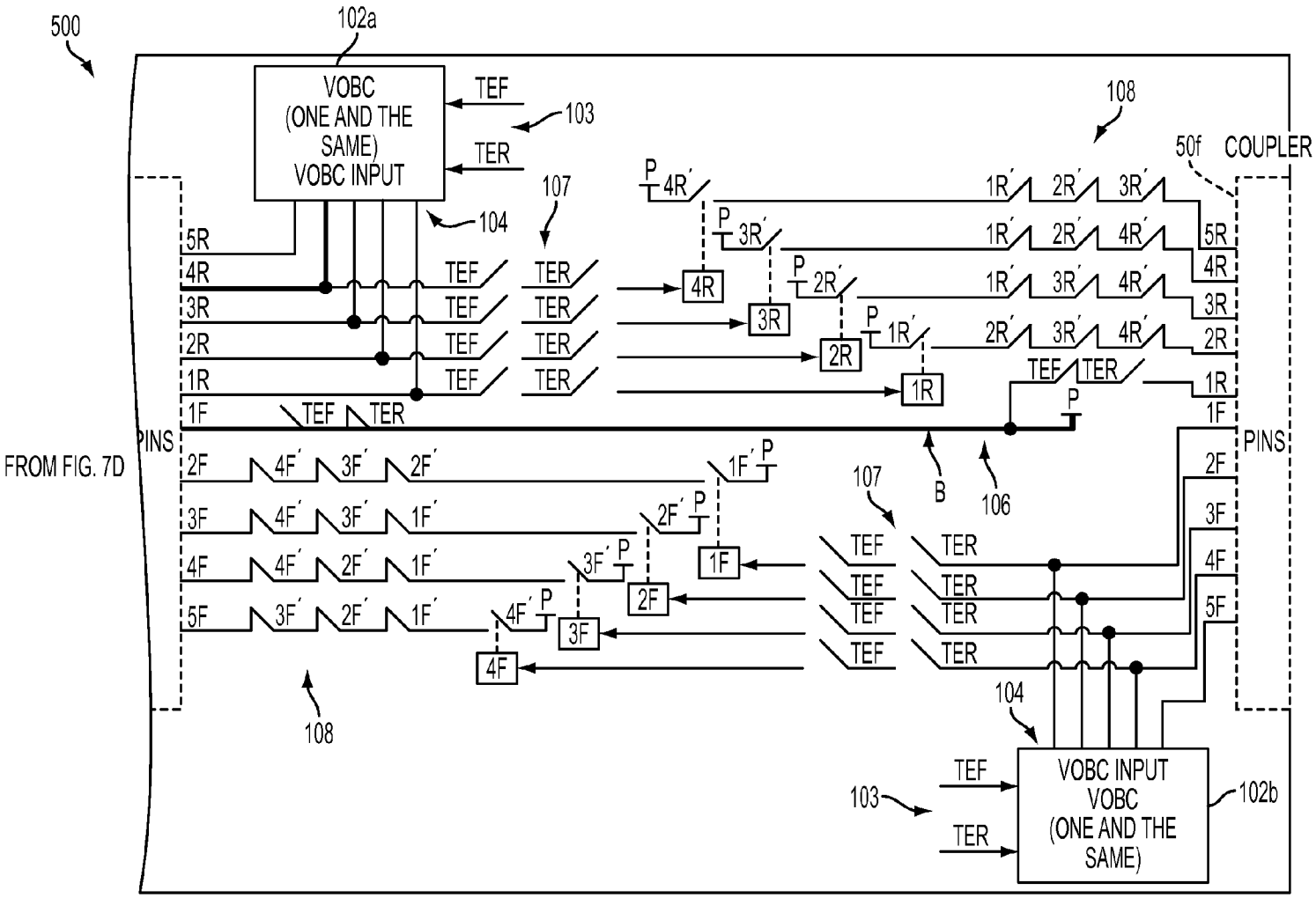

As shown in FIG. 7E, at the same time, in the train unit 500 (at the rear of the train system 10), the second communication signal "B" is transmitted toward the front of the train system 10. TEF is energized via the coupler 50*e* and the second communication signal "B" is transmitted via the input 1F, and energizes the input 1F at the controller 102*b* indicating that one train unit (e.g., train unit 500) is behind train unit 400. TEF is energized (coupled both ends) within the train unit 400 shown in FIG. 7D and the second communication signal "B" continues to travel along train line 106 and energizes the relay 2F therein and in turn energizes the input 2F at the controller 102*b* of the train unit 300 shown in FIG. 7C indicating that there are two train units (e.g., train units 400 and 500) behind train unit 300. As TEF of the train unit 300 is energized and the second communication signal "B" is then transmitted within the train unit 300 and the relay 2F is energized and in turn energizes input 3F at the controller 102*b* of the train unit 200 shown in FIG. 7B indicating that there are three train units (e.g., train units 300, 400 and 500) behind the train unit 200. In the train unit 200, TEF is energized, thereby energizing the relay 3F and the input 4F at the controller 102*b* of the train unit 100 shown in FIG. 7A indicating that there are four train units (e.g., train unit 200, 300, 400 and 500) behind train unit 100.

As can be seen in the figures, as the number of train units increase, the number of the input to each respective controller 102*a* and 102*b* increases thereby allowing each controller 102*a* and 102*b* to determine a location thereof within the train system 10, and the configuration of the train system 10 (i.e., the train length).

According to one or more other embodiments, in a train configuration having a different orientation of the controllers 102*a* and 102*b*, each controller 102*a* and 102*b* according to its corresponding correlation on the guideway can determine if it is coupled front and rear relative to the direction of the guideway. A correlation is an indication to each controller 102*a* and 102*b* of a corresponding orientation relative to a positive or negative direction on the guideway. A front facing controller 102*a* or 102*b* has a correlation of (0) zero while a rear facing controller 102*a* or 102*b* has a correlation of (1) one relative to the positive direction of the guideway.

FIGS. 8A through 8D of four train units 600, 700, 800 and 900 which are coupled together in a random configuration relative to a positive direction of the guideway. A correlation of the train units 600 through 900 is as follows: train unit 600 has a correlation=1; train unit 700 has a correlation=0, train unit 800 has a correlation=0; and train unit 900 has a correlation=1.

The status of each input of the controllers 102*a*, 102*b* of train units 600, 700, 800 and 900 is shown in Table 80 (VOBC inputs shown in FIGS. 8A through 8D) as follows:

| VOBC Inputs | 600 | 700 | 800 | 900 |
|---|---|---|---|---|
| TEF | EN | EN | EN | NE |
| TER | NE | EN | EN | EN |
| 1F | NE | NE | EN | NE |
| 2F | NE | EN | NE | NE |
| 3F | NE | NE | NE | EN |
| 4F | NE | NE | NE | NE |
| 5F | NE | NE | NE | NE |
| 1R | NE | EN | NE | NE |
| 2R | NE | NE | EN | NE |
| 3R | EN | NE | NE | NE |
| 4R | NE | NE | NE | NE |
| 5R | NE | NE | NE | NE |

Figure 8A:
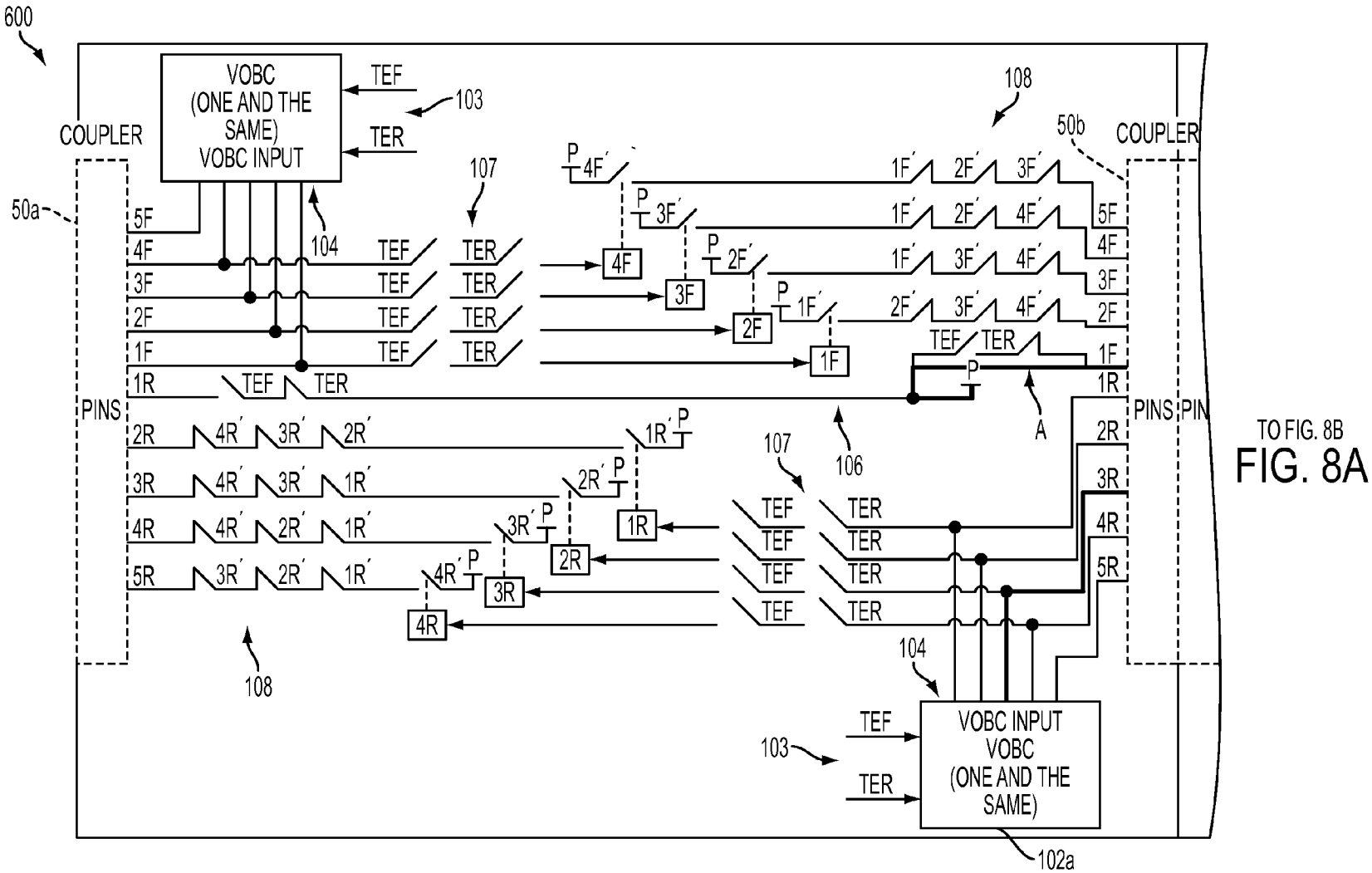
FIGS. 8A through 8D are diagrams of four train units coupled together in a random configuration in accordance with one or more embodiments.
Figure 8B:
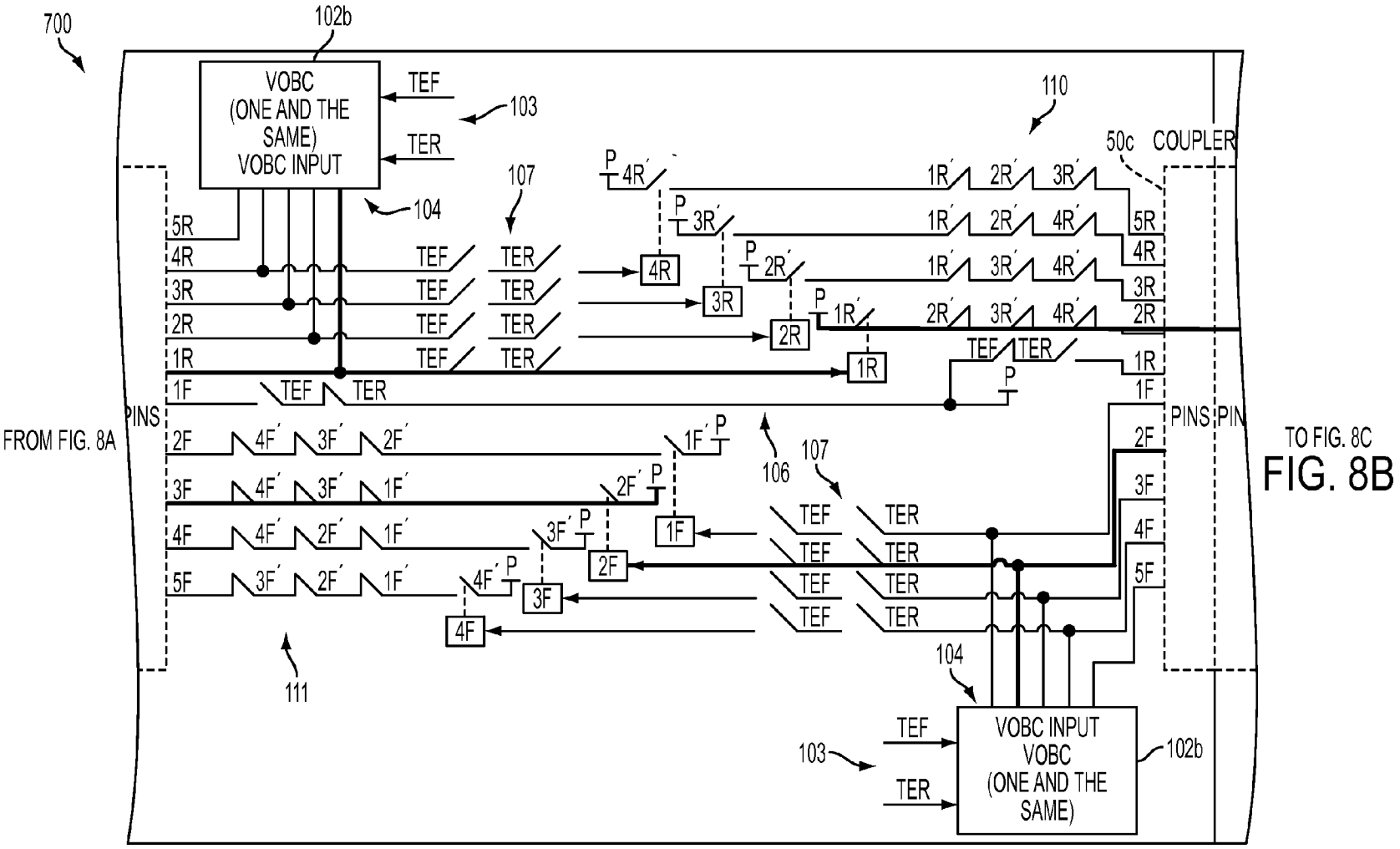
Figure 8C:
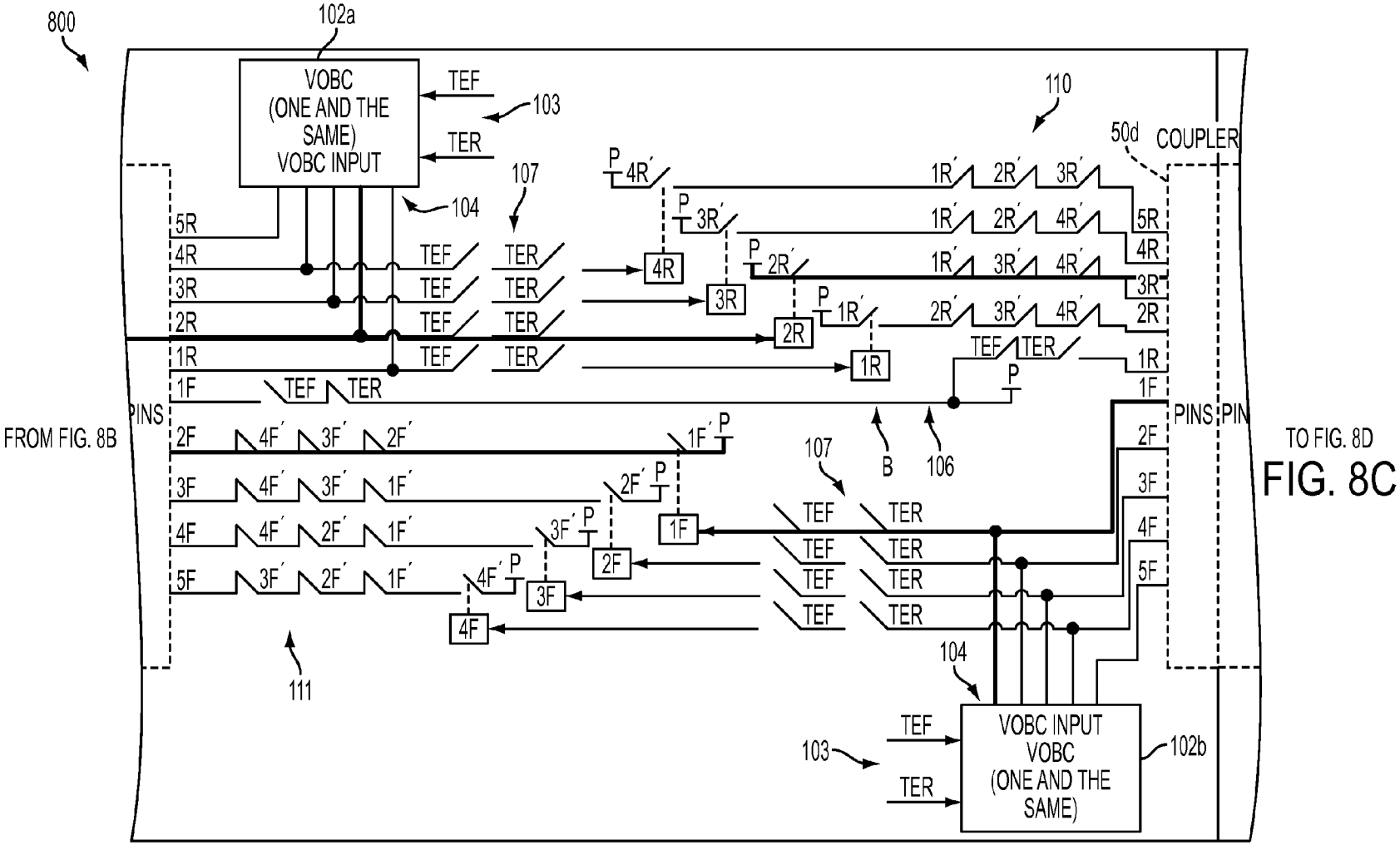

In FIG. 8A, in train unit 600, the TER is energized via the coupler 50*b* to indicate that the train unit 600 is coupled at a rear to the train unit 700 shown in FIG. 8B, thereby energizing the input 1R at controller 102*a* of the train unit 700 indicating that one train unit (e.g., train unit 600) is in front of train unit 700.

Further as shown in FIG. 8B, in the train unit 700, TER is energized via coupler 50*c* to indicate that the train unit 700 is coupled with the train unit 800 (shown in FIG. 8C), and the first communication signal "A" is then transmitted and energizes the relay 110 (1R') which in turn energizes the input 2R at the controller 102*a* of the train unit 800 indicating that two train units (e.g., train units 600 and 700) are in front of train unit 800.

Figure 8D:
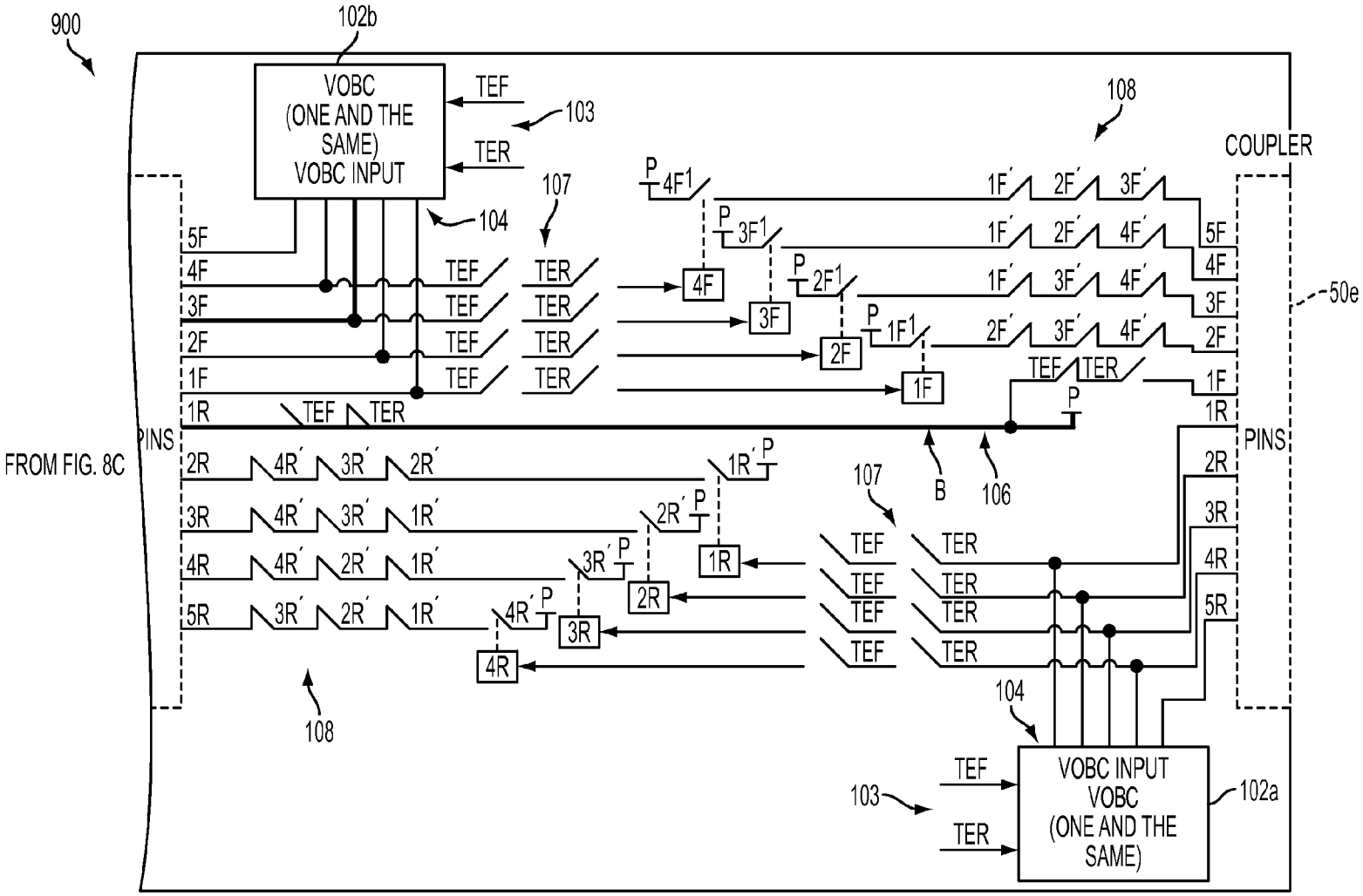

TER of train unit 800 is energized via the coupler 50*d* to indicate that the train unit 800 is coupled with the train unit 900 (shown in FIG. 8D). The first communication signal "A" energizes the relay 110 (2R') which in turn energizes the input 3F at controller 102*b* of train unit 900 indicating to the train unit 900 that there are three train units (e.g., train units 600, 700 and 800) in front of the train unit 900.

Further, as shown in FIG. 8D, train unit 900 (at the rear of the train system 10), the communication signal "B" is transmitted toward the front of the train system 10. In train unit 900, TEF is energized by the coupler 50*d* to indicate that the train unit 900 is coupled at a front thereof to the train unit 800, and the second communication signal "B" is transmitted to the train unit 800 shown in FIG. 8C via the input 1R. In train 800, the second communication signal ""B" energizes the input 1F at the controller 102*b* of train unit 800 indicating that there is one train unit (e.g., the train unit 900) behind the train unit 800. The second communication signal "B" passes through the energized TEF and energizes the relay 1F, and is transmitted via the input 2F to the train unit 700 shown in FIG. 8B.

Further, as shown in FIG. 8B, the train unit 700, the input 2F is energized at the controller 102*b* indicating that there are two train units (e.g., the train units 800 and 900) behind the train unit 700.

The second communication signal "B" is passed through the energized TEF and energizes the relay 111 (2F') which in turn energizes the input 3R at the controller 102*a* of the train unit 600 shown in FIG. 8A indicating that there are three train units (e.g., the train units 700, 800 and 900) behind the train unit 600.

One or more embodiments of the present disclosure include a method of automatically determining a configuration/formation of a train, without the use of inputs to/from external wayside devices. Each train onboard controller (VBOC) of each train unit (e.g., car) independently determines the train configuration/formation (i.e., the train length) without the use of a secondary device.

For systems having predetermined configuration of train units, and systems having variable configuration of train units, the determination of configuration/formation is performed without having to move the train system after a cold start.

Further, in one or more embodiments of the present disclosure, when a train system configuration has different orientation of VOBCs in the train system relative to the guideway, a determination of a location of the VOBC relative to the front of the train system is made after the respective VOBC has established an orientation thereof on the guideway. A respective VOBC according to a corresponding correlation on the guideway, determines whether the respective VOBC is coupled front and/or rear relative to the direction of the guideway.

Figure 9:
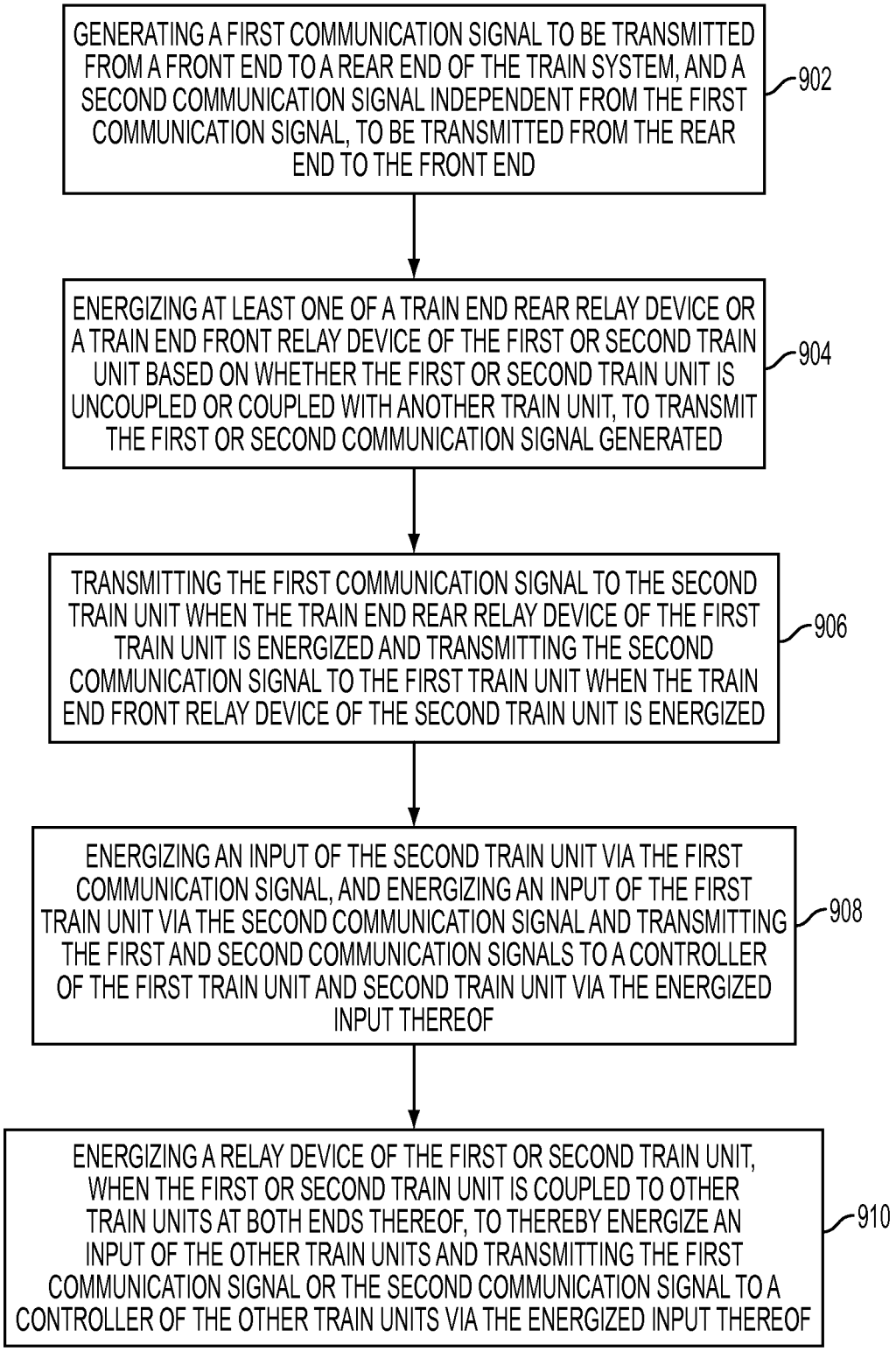
FIG. 9 is a flow diagram of a method of controlling a train system in accordance with one or more embodiments.

FIG. 9 is a flow diagram of a method of controlling a train system in accordance with one or more embodiments. The method begins at operation 902, where a first communication signal "A" is generated to be transmitted from a front end to a rear end of the train system 10, and a second communication signal "B" independent from the first communication signal "A" is generated to be transmitted from the rear end to the front end. From operation 902, the process continues to operation 904, wherein at least one of a TER or a TEF of the first or second train unit 100, 200 is energized based on whether the first or second train unit 100, 200 is uncoupled or coupled with another train unit (e.g., train unit 300 or 400), in order to transmit the first or second communication signal "A", "B" generated.

The process then continues to operation 906, where the first communication signal "A" is transmitted to the second train unit 200 when the TER of the first train unit 100 is energized and the second communication signal "B" is transmitted to the first train unit 100 when the TEF of the second train unit 200 is energized.

From operation 906, the process continues to operation 908 where an input 104 of the second train unit 200 is energized via the first communication signal "A" and an input 104 of the first train unit 100 is energized via the second communication signal "B" and the first and second communication signals "A", "B" are transmitted to a controller 102*a*, 102*b* of the first train unit 100 and second train unit 200 via the energized input 104 thereof.

From operation 908, the process continues to operation 910, where a relay device 108 of the first or second train unit 100, 200 is energized, when the first or second train unit 100, 200 is coupled to other train units (e.g., train units 300, 400)

at both ends thereof, to thereby energize an input 104 of the other train unit and the first communication signal "A" or the second communication signal "B" is transmitted to a controller 102*a*, 102*b* of the other train units via the energized input 104 thereof.

One or more embodiments of the present disclosure includes a train system, comprising a plurality of train units including a first train unit and a second train unit coupled together, each first and second train unit comprising: a controller configured to independently determine a location of the controller, and a configuration of the train system and by comprising a plurality of inputs; a plurality of train lines spanning each train unit and coupled with the controllers at the plurality of inputs and configured to transmit separate communication signals between a front end and a rear end of the train system; and a plurality of sets of relay devices connected in series along the plurality of train lines, and each set of relay devices corresponding to each input of the plurality of inputs, and configured to transmit the communication signals between the front end and the rear end of the system.

One or more embodiments of the present disclosure include a train system comprising a plurality of train units including a first train unit and a second train unit, each first and second train unit comprising: a controller configured to independently determine a location of each train unit, and a configuration of the train system and comprising a plurality of inputs; a plurality of train lines spanning each train unit and coupled with the controllers at the plurality of inputs and configured to transmit separate communication signals between a front and a rear of the first and second train units; and a pair of train end relay devices connected in series along the plurality of train lines, and configured to be energized based on whether the first train unit and the second train unit is coupled or uncoupled; and a plurality of sets of relay devices connected in series along the plurality of train lines, and each set of relay devices corresponding to each input of the plurality of inputs, and configured to transmit the communication signals between the front end and the rear end of the train system, if energized upon confirmation of whether the first train unit is coupled to the second train unit.

One or more embodiments of the present disclosure include a method of controlling a train system including a first train unit and a second train unit coupled together, the method comprising transmitting separate communication signals between the first and second train units, via a plurality of sets of relay devices connected in series along a plurality of train lines, between the first and second train units, to determine within each train unit, a location of each train unit and a configuration of the train system, via a controller of each train unit.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A train system, comprising:

a plurality of train units including a first train unit and a second train unit coupled together, each first and second train unit comprising:

a controller configured to independently determine a location of the controller and a configuration of the train system, the controller comprising a plurality of inputs;

a plurality of train lines spanning the first or second train unit and coupled with the controller at the plurality of inputs, the plurality of train lines configured to transmit separate communication signals between a front end and a rear end of the train system; and a plurality of sets of relay devices connected in series along the plurality of train lines, each set of relay devices corresponding to each input of the plurality of inputs, wherein each set of relay devices is configured to further transmit the communication signals between the front end and the rear end of the train system.

2. The train system of claim 1, wherein the communication signals comprise a first communication signal and a second communication signal independently generated such that the first communication signal is transmitted from the front end of the train system to the rear end of the train system, and the second communication signal is transmitted from the rear end of the train system to the front end of the train system, and the first communication signal indicates a number of train units in front of a respective train unit and the second communication signal indicates a number of train units behind the respective train unit.

3. The train system of claim 2, wherein the plurality of sets of relay devices further comprises:

train end relay devices comprising a train end front relay device and a train end rear relay device, and configured to be energized based upon whether the first or second train units are uncoupled or coupled to each other.

4. The train system of claim 3, wherein the plurality of sets of relay devices are force actuated relays.

5. The train system of claim 3, wherein the train end rear relay device of the first train unit is energized, and the first communication signal is transmitted to the second train unit, energizing an input within the second train unit, wherein the first communication signal is transmitted to the controller of the second train unit via the energized input of the second train unit, and the train end front relay device of the second train unit is energized, and the second communication signal is transmitted to the first train unit, energizing an input thereof, wherein the second communication signal is transmitted to the controller of the first train unit via the energized input of the first train unit.

6. The train system of claim 3, further comprising a third train unit coupled to the second train unit, and the first, second and third train units being in a predetermined configuration, wherein the train end rear relay device of the first train unit is energized and the first communication signal is transmitted to the second train unit, energizing an input, and a relay device within the second train unit, and transmitted to the controller of the second train unit via the energized input of the second train unit, and the first communication signal is transmitted to the third train unit via the energized relay device, and energizes an input of the third train unit thereby transmitting the first communication signal to the controller of the third train unit via the energized input thereof;

the train end front relay device of the third train unit is energized, and the second communication signal is transmitted to the second train unit, energizing an input of the second train unit, wherein the second communication signal is transmitted to the controller of the second train unit via the energized input of the second train unit; and the train end front relay device of the second train unit is energized and a relay device of the second train unit is energized via the second communication signal, and the second communication signal is transmitted to the first train unit via a train line of the plurality of train lines, energizing an input of the first train unit, the second communication signal is transmitted to the controller of the first train unit via the energized input of the first train unit.

7. The train system of claim 3, further comprising a third train unit coupled to the second train unit and the first, second and third train units being in a random configuration, wherein each controller of the first second and third train units is configured to determine a location thereof within the train system based on a corresponding correlation on a guideway, wherein a controller facing a front end of a respective train unit includes a correlation of 0 relative to a negative direction of the guideway, and a controller facing a rear end of a respective train unit includes a correlation of 1 relative to a positive direction of the guideway.

8. The train system of claim 5, wherein energized input within the first train unit is different from the energized input within the second train unit.

9. A train system comprising:

a plurality of train units including a first train unit and a second train unit, each first and second train unit comprising:

a controller configured to independently determine a location of the first or second train unit, and a configuration of the train system, the controller comprising a plurality of inputs;

a plurality of train lines spanning the first or second train unit and coupled with the controller at the plurality of inputs and configured to transmit separate communication signals between a front end and a rear end of the train system; and a pair of train end relay devices connected in series along the plurality of train lines, each train end relay device configured to be energized based on whether the first or second train unit is coupled or uncoupled with another train unit; and a plurality of sets of relay devices connected in series along the plurality of train lines, each set of relay devices corresponding to each input of the plurality of inputs, wherein each set of relay devices is configured to further transmit the communication signals between the front end and the rear end of the train system, if energized upon confirmation of whether the first train unit is coupled to the second train unit.

10. The train system of claim 9, wherein the communication signals comprise a first communication signal and a second communication signal independently generated such that the first communication signal is transmitted from the front end of the train system to the rear end of the train system, and the second communication signal is transmitted from the rear end of the train system to the front end of the train system, and the first communication signal indicates a number of train units in front of a respective train unit and the second communication signal indicates a number of train units behind the respective train unit.

11. The train system of claim 9, wherein the plurality of sets of relay devices are force actuated relays.

12. The train system of claim 10, wherein if the first and second train units are coupled together, the train end rear relay device of the first train unit is energized and the first communication signal is transmitted to the second train unit, energizing an input within the second train unit, wherein the first communication signal is transmitted to the controller of the second train unit via the energized input of the second train unit, and the train end front relay device of the second train unit is energized, and the second communication signal is transmitted to the first train unit, energizing an input thereof, wherein the second communication signal is transmitted to the controller of the first train unit via the energized input of the first train unit.

13. The train system of claim 10, further comprising a third train unit coupled to the second train unit, and the first, second and third train units being in a predetermined configuration, wherein the train end rear relay device of the first train unit is energized, and the first communication signal is transmitted to the second train unit, energizing an input and a relay device within the second train unit, and transmitted to the controller of the second train unit via the energized input of the second train unit, and the first communication signal is transmitted to the third train unit via the energized relay device, and energizes an input of the third train unit thereby transmitting the first communication signal to the controller of the third train unit via the energized input thereof;

the train end front relay device of the third train unit is energized, and the second communication signal is transmitted to the second train unit, energizing an input of the second train unit, wherein the second communication signal is transmitted to the controller of the second train unit via the energized input of the second train unit; and the train end front relay device of the second train unit is energized and a relay device of the second train unit is energized via the second communication signal, and the second communication signal is transmitted to the first train unit via a train line of the plurality of train lines, energizing an input of the first train unit, the second communication signal is transmitted to the controller of the first train unit via the energized input of the first train unit.

14. The train system of claim 9, wherein each relay device of the pair of train end relay devices is a force actuated relay.

15. A method of controlling a train system including a first train unit and a second train unit coupled together, the method comprising:

transmitting separate communication signals, via a plurality of sets of relay devices connected in series along a plurality of train lines, between the first and second train units, and determining, within each train unit, a location of each train unit and a configuration of the train system, via a controller of each train unit, based on a first communication signal or a second communication signal of the separate communication signals transmitted by a relay device of the plurality of sets of relay devices.

16. The method of claim 15, wherein transmitting separate communication signals comprises:

generating the first communication signal to be transmitted from the front end to the rear end of the train system, and generating the second communication signal independent from the first communication signal, to be transmitted from the rear end to the front end, the first communication signal indicating a number of train units in front of a respective train unit and the second communication signal indicating a number of train units behind the respective train unit.

17. The method of claim 16, wherein transmitting separate communication signals further comprises:

energizing at least one of a train end rear relay device or a train end front relay device of the first or second train unit, based on whether the first or second train unit is uncoupled or coupled with another train unit; and transmitting the first communication signal to the second train unit when the train end rear relay device of the first train unit is energized, and transmitting the second communication signal to the first train unit when the train end front relay device of the second train unit is energized.

18. The method of claim 17, wherein transmitting the first and second communication signals further comprises:

energizing an input of the second train unit via the first communication signal, and transmitting the first communication signal to the controller of the second train unit via the energized input of the second train unit; and energizing an input of the first train unit via the second communication signal, and transmitting the second communication signal to the controller of the first train unit via the energized input of the first train unit.

19. The method of claim 18, wherein transmitting the first and second communication signals further comprises:

energizing a relay device of the first or second train unit, when the first or second train unit is coupled to another train unit at an end thereof, to thereby energize an input of the another train unit and transmit the first communication signal or the second communication signal to the controller of the another train unit.

20. The method of claim 19, further comprising determining the location of each train unit based on a corresponding correlation on a guideway, wherein a controller facing a front end of each train unit includes a correlation of 0 relative to a negative direction of the guideway, and a controller facing a rear end of each train unit includes a correlation of 1 relative to a positive direction of the guideway.

* * * * *